US011920878B2

(12) United States Patent
Tatavarthy et al.

(10) Patent No.: US 11,920,878 B2
(45) Date of Patent: Mar. 5, 2024

(54) CONTINUOUS HELICAL BAFFLE HEAT EXCHANGER

(71) Applicant: WATLOW ELECTRIC MANUFACTURING COMPANY, St. Louis, MO (US)

(72) Inventors: Satya Tatavarthy, St. Louis, MO (US); Ethan Dinauer, St. Louis, MO (US); Sanhong Zhang, Ballwin, MO (US); Scott H. Boehmer, Hannibal, MO (US); Scott Yarbrough, St. Louis, MO (US); Jacob Wilson, St. Charles, MO (US)

(73) Assignee: Watlow Electric Manufacturing Company, St. Louis, MO (US)

( * ) Notice: Subject to any disclaimer, the term of this patent is extended or adjusted under 35 U.S.C. 154(b) by 0 days.

(21) Appl. No.: 17/954,447

(22) Filed: Sep. 28, 2022

(65) Prior Publication Data

US 2023/0058788 A1 Feb. 23, 2023

Related U.S. Application Data

(63) Continuation-in-part of application No. 17/064,808, filed on Oct. 7, 2020, now Pat. No. 11,486,660, which
(Continued)

(51) Int. Cl.
*F28F 9/22* (2006.01)
*F28D 7/06* (2006.01)
(Continued)

(52) U.S. Cl.
CPC ..... *F28F 9/22* (2013.01); *F28D 7/06* (2013.01); *F28D 7/1607* (2013.01);
(Continued)

(58) Field of Classification Search
CPC .. F28F 9/22; F28F 2009/222; F28F 2009/228; F28D 7/06; F28D 7/1607; F28D 7/1676
(Continued)

(56) References Cited

U.S. PATENT DOCUMENTS 948,835 A * 2/1910 Walter ..... F28F 9/22 165/DIG. 406
1,525,094 A * 2/1925 Jones ..... F28F 9/24 165/161
(Continued)

FOREIGN PATENT DOCUMENTS

DE 102011015215 A1 * 9/2012 ..... F24H 1/102
GB 1438925 A 6/1976
(Continued)

OTHER PUBLICATIONS

Wang, et al., Heat Transfer Enhancement of Folded Helical Baffle Electric Heaters with One-plus-two U-tube Units, Applied Thermal Engineering, Mar. 31, 2016, pp. 586-595, vol. 102, Elsevier Ltd.
(Continued)

*Primary Examiner* — Jon T. Schermerhorn, Jr.
(74) *Attorney, Agent, or Firm* — Burris Law, PLLC

(57) ABSTRACT

A heater includes a flow guide and electrical resistance heating elements. The flow guide defines a continuous geometric helicoid disposed about a longitudinal axis and defines perforations that extend in a longitudinal direction through a first longitudinal length of the geometric helicoid. The first longitudinal length is less than a full longitudinal length of the geometric helicoid. The electrical resistance heating elements extend through the perforations. For each electrical resistance heating element, a length of that electrical resistance heating element and a pitch of the geometric helicoid at a distal end of that electrical resistance heating element are such that the distal end of that electrical resistance heating element is a distance X from the geometric
(Continued)

helicoid at the distal end of that electrical resistance heating element. The distance X is less than or equal to 40% of the pitch at the distal end of that electrical resistance heating element.

20 Claims, 22 Drawing Sheets

Related U.S. Application Data is a continuation of application No. 16/114,631, filed on Aug. 28, 2018, now Pat. No. 10,941,988.

(60) Provisional application No. 62/550,969, filed on Aug. 28, 2017.

(51) Int. Cl.
*F28D 7/16* (2006.01)
*F28F 9/013* (2006.01)

(52) U.S. Cl.
CPC ..... *F28D 7/1676* (2013.01); *F28F 9/0131* (2013.01); *F28F 2009/222* (2013.01); *F28F 2009/228* (2013.01)

(58) Field of Classification Search
USPC ..... 165/159
See application file for complete search history.

(56) References Cited

U.S. PATENT DOCUMENTS 1,672,650 A * 6/1928 Lonsdale ..... F28F 9/22 165/DIG. 411
1,782,409 A * 11/1930 Chute ..... F28F 9/22 165/161
2,654,820 A * 10/1953 Robert ..... H05B 3/78 392/503
2,775,683 A * 12/1956 Kleist ..... F28D 7/106 392/397
3,446,939 A * 5/1969 Lowe ..... F24H 1/202 392/452
3,835,294 A * 9/1974 Krohn ..... F24H 1/121 392/494
4,346,287 A * 8/1982 Desloge ..... H05B 3/46 219/544
4,360,059 A * 11/1982 Funke ..... F28D 7/026 165/184
4,395,618 A * 7/1983 Cunningham ..... F24H 1/102 392/492
4,410,553 A 10/1983 McGinty
4,465,922 A * 8/1984 Kolibas ..... F24H 1/121 392/494
4,480,172 A * 10/1984 Ciciliot ..... H05B 3/42 261/142
4,792,661 A * 12/1988 Schmidtchen ..... G03D 13/006 165/290
4,808,793 A * 2/1989 Hurko ..... F24H 1/102 392/480
5,443,053 A * 8/1995 Johnson ..... F02M 31/16 123/557
6,028,882 A * 2/2000 Smith ..... F27D 9/00 373/113
6,124,579 A * 9/2000 Steinhauser ..... H05B 3/46 219/544
6,147,335 A * 11/2000 Von Arx ..... H05B 1/0291 219/544
6,167,951 B1 * 1/2001 Couch ..... C02F 1/725 165/160
6,289,177 B1 * 9/2001 Finger ..... H05B 3/06 392/455
6,300,607 B1 * 10/2001 Steinhauser ..... H05B 3/18 219/544
6,337,470 B1 * 1/2002 Von Arx ..... H05B 3/48 219/544
6,393,212 B1 * 5/2002 Hutchinson ..... F04B 19/027 392/491
6,414,281 B1 * 7/2002 Long ..... H05B 3/44 219/544
6,513,583 B1 * 2/2003 Hughes ..... F28D 7/1607 165/162
6,827,138 B1 * 12/2004 Master ..... F28F 9/22 165/162
7,286,752 B2 * 10/2007 Gourand ..... H05B 3/262 392/479
7,458,807 B2 * 12/2008 Alfoldi ..... F16L 53/38 431/11
8,295,692 B2 * 10/2012 McClanahan ..... F28F 9/22 138/40
8,391,696 B2 * 3/2013 McClanahan ..... F28F 13/06 138/40
8,540,011 B2 * 9/2013 Wang ..... F28F 9/0131 165/145
8,731,386 B2 * 5/2014 Waechter ..... H05B 3/42 392/491
9,222,698 B2 * 12/2015 McClanahan ..... F28F 9/22
9,464,847 B2 * 10/2016 Maurer ..... F28D 7/1669
9,528,722 B1 * 12/2016 Hansen ..... F24H 1/102
10,247,445 B2 * 4/2019 Everly ..... F24H 9/2028
10,728,956 B2 * 7/2020 Reynolds ..... H05B 1/0202
2006/0135831 A1 6/2006 Butler et al.
2007/0181292 A1 * 8/2007 Jekerle ..... F28F 9/22 165/162
2008/0190593 A1 * 8/2008 Wang ..... F28F 9/22 29/890.03
2009/0013676 A1 * 1/2009 Capelle ..... F28D 7/1692 165/172
2011/0129205 A1 * 6/2011 Slayton ..... F24H 1/101 392/488
2012/0073955 A1 * 3/2012 McClanahan ..... B01D 1/0023 203/99
2013/0047661 A1 * 2/2013 Janssens ..... B01D 53/261 62/474
2016/0018168 A1 1/2016 Urbanski
2016/0273845 A1 * 9/2016 Rizzi ..... F01K 5/02
2017/0115072 A1 * 4/2017 Machalek ..... F28F 13/06
2018/0106551 A1 * 4/2018 Hofmeister ..... F28D 21/0008

FOREIGN PATENT DOCUMENTS

JP S5063301 A 5/1975
JP S51117271 U 9/1976
JP S553502 A 1/1980
JP S5883193 A 5/1983
WO WO-2014111015 A1 * 7/2014 ..... F28D 7/08

OTHER PUBLICATIONS

Extended European Search Report issued in corresponding EP Application 23178502.3, dated Aug. 21, 2023, 7 pages.

* cited by examiner

CONTINUOUS HELICAL BAFFLE HEAT EXCHANGER

CROSS-REFERENCE TO RELATED APPLICATIONS

This application is a continuation-in-part of U.S. application Ser. No. 17/064,808, filed Oct. 7, 2020, which is a continuation of U.S. application Ser. No. 16/114,631, filed Aug. 28, 2018, which became U.S. Pat. No. 10,941,988 and claims the benefit of priority from U.S. provisional application No. 62/550,969, filed Aug. 28, 2017. The above-mentioned applications and patents are incorporated herein by reference in their entireties.

FIELD

The present disclosure relates generally to heating apparatuses, and more particularly to heat exchangers for heating fluid.

BACKGROUND

The statements in this section merely provide background information related to the present disclosure and may not constitute prior art.

Heat exchangers generally include a tubular vessel and a plurality of heating elements disposed inside the tubular vessel. Working fluid enters the tubular vessel at one longitudinal end and exits at the other longitudinal end. The working fluid is heated by the plurality of heating elements as the working fluid flows inside the tubular vessel. In fluid-to-fluid heat exchangers, the heating elements are tubes through which a heating fluid flows. The heat is transferred from the heating fluid to the working fluid via the walls of the tubes. In electric heat exchangers, the heating elements are electric heating elements (e.g., resistance heating elements).

In order to more quickly and efficiently heat the working fluid, a typical heat exchanger may increase the total heat exchange area or increasing the heat flux of the heating elements, to increase the heat output. However, typical methods of increasing the total heat exchange area can take more space in the heat exchanger that could otherwise be used for containing the working fluid and typical methods of increasing the heat flux of the heating elements can be limited by the materials and design of the heating elements, as well as other application specific requirements.

SUMMARY

In one form, a heater assembly is provided, which includes a continuous series of helical members and a plurality of heating elements. Each helical member defines opposed edges and a predetermined pattern of perforations extending through each helical member and parallel to a longitudinal axis of the heater assembly. The plurality of heating elements extend through the perforations (and in one form through all of the perforations) of the continuous series of helical members. The continuous series of helical members define a geometric helicoid.

In another form, an electric heat exchanger includes a body defining a cavity, a heater assembly disposed within the cavity, and a proximal flange configured to secure the heater assembly to the body. The heater assembly defines a longitudinal axis and includes a continuous series of helical members and a plurality of heating elements. Each helical member defines opposed edges and a predetermined pattern of perforations extending through each helical member and parallel to the longitudinal axis. The plurality of heating elements extend through the perforations of the continuous series of helical members. The continuous series of helical members define a geometric helicoid.

In still another form, in an electric heat exchanger, a device provides a consistent linear temperature rise along a length of the electric heat exchanger. The device includes a continuous series of helical members. Each helical member defines opposed edges and a predetermined pattern of perforations extending through each helical member and parallel to a longitudinal axis of the electric heat exchanger. The continuous series of helical members define a geometric helicoid and the perforations are configured to receive heating elements.

In one form, a heater assembly includes a continuous series of perforated helical members and a plurality of heating elements. The perforated helical members cooperate to define a geometric helicoid disposed about a longitudinal axis of the heater assembly. Each perforated helical member defines opposed edges and a predetermined pattern of perforations. The perforations extend through each perforated helical member parallel to the longitudinal axis. The heating elements extend through the perforations.

According to another form, each heating element includes a first segment, a second segment, and a bend connecting the first and second segments. The first segment extends through a first set of the perforations. The second segment extends through a second set of the perforations. The second set of the perforations are parallel to and offset from the first set of the perforations.

According to a further form, the plurality of heating elements are arranged in a concentric pattern.

According to yet another form, the heater assembly further includes a central support member. Each of the perforated helical members defines a central aperture and the central support member extends through the central aperture.

According to another form, the heater assembly further includes a temperature sensor that extends through an interior of the central support member, the temperature sensor including a probe external of the central support member.

According to another form, the heater assembly further includes a proximal flange configured to secure the heater assembly to a heat exchanger body. The flange defines a plurality of flange apertures and a central groove. The flange apertures are aligned with the perforations of the perforated helical members. The heating elements extend through the flange apertures. The central support member are received in the central groove.

According to another form, the heater assembly further includes a vent aperture providing fluid communication between an exterior of the central support member and an interior of the central support member proximate to the flange.

According to another form, the central support member includes at least one additional heater.

According to another form, the heater assembly further includes a non-perforated helical member disposed at a distal end of the continuous series of perforated helical members, the non-perforated helical member forming an extension of the geometric helicoid.

According to another form, each of the heating elements is secured to at least a portion of each perforation through which each heating element extends.

According to another form, the opposed edge from one helical member overlaps with the opposed edge from an adjacent helical member.

According to another form, the opposed edge from one helical member is spaced apart from the opposed edge from an adjacent helical member and connected thereto by a bridging member.

According to another form, the heater assembly further includes a plurality of rods extending parallel to the longitudinal axis. A periphery of each perforated helical member defines a plurality of grooves, and the rods are at least partially disposed within a corresponding set of the grooves.

According to another form, the rods extend outward from the grooves beyond the periphery of each perforated helical member. The heater assembly is configured to be received within a cylindrical cavity of a body and the rods are configured to provide sliding contact with a wall of the body that defines the cylindrical cavity.

According to another form, the heater assembly further includes a shroud disposed about at least one of the perforated helical members and coupled to the rods.

According to another form, the rods do not extend outward beyond the periphery of each perforated helical member.

According to another form, the shroud is a heat shield configured to reflect radiant energy radially inward relative to the longitudinal axis.

According to another form, the shroud includes at least one skirt defining a plurality of deformable flaps that extend radially outward relative to the longitudinal axis.

According to another form, the at least one skirt is disposed proximate to a proximal end portion or a distal end portion of the heater assembly.

According to another form, the at least one skirt includes a first skirt and a second skirt. The first skirt is disposed at a proximal end portion of the heater assembly and the second skirt is disposed at a distal end portion of the heater assembly.

According to another form, the continuous series of perforated helical members defines a variable pitch.

According to another form, the continuous series of perforated helical members has a longer pitch proximate to an inlet end of the heater assembly than an outlet end of the heater assembly.

According to another form, the heating elements are electrical resistance heating elements.

According to another form, the electrical resistance heating elements are one of the group of: a tubular heater, a cartridge heater, or a multi-cell heater.

According to another form, the plurality of heating elements includes a first heating element and a second heating element, the first heating element having a different length than the second heating element.

According to another form, the heater assembly further includes an alignment plate disposed coaxially about the longitudinal axis. The alignment plate defines a plurality of plate apertures that align with perforations of the perforated helical members.

In another form, a heat exchanger includes a body, a heater assembly, and a proximal flange. The body defines a cylindrical cavity. The heater assembly defines a longitudinal axis. The heater assembly includes a continuous series of perforated helical members and a plurality of heating elements. The perforated helical members are disposed within the cylindrical cavity and defines a geometric helicoid. Each perforated helical member defines opposed edges and a predetermined pattern of perforations extending through each perforated helical member and parallel to the longitudinal axis. The heating elements extend through the perforations of the perforated helical members. The proximal flange secures the heater assembly to the body.

According to another form, the heat exchanger further includes a plurality of rods extending longitudinally parallel to the longitudinal axis. A periphery of each perforated helical member defines a plurality of grooves, and the rods are partially disposed within a corresponding set of the grooves and have a thickness that extends radially outward of the periphery of the perforated helical members so that the rods are in sliding contact with an interior wall of the body that defines the cylindrical cavity.

According to another form, the heat exchanger further includes a skirt that includes elastically deformable flaps that extend radially between the perforated helical members and an interior wall of the body that defines the cylindrical cavity.

According to another form, the body includes an inlet at a proximal end of the cylindrical cavity and an outlet at a distal end of the cylindrical cavity. The heater assembly further includes a non-perforated helical member coupled to a last one of the continuous series of perforated helical members. The non-perforated helical member forms an extension of the geometric helicoid and begins along the geometric helicoid at or before the outlet.

According to another form, the non-perforated helical member has a pitch equal to a diameter of the outlet.

In another form, a heater assembly includes a continuous perforated helical baffle and a plurality of heating elements. The baffle defines a geometric helicoid about a longitudinal axis. The perforated helical baffle defines a predetermined pattern of perforations extending through the perforated helical baffle and parallel to the longitudinal axis. The heating elements extend through the perforations.

According to a further form, the geometric helicoid has a pitch that varies along the longitudinal axis.

According to a further form, the pitch is continuously variable.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The present disclosure will become more fully understood from the detailed description and the accompanying drawings, wherein.

Corresponding reference numerals indicate corresponding parts throughout the several views of the drawings.

DETAILED DESCRIPTION

The following description is merely exemplary in nature and is not intended to limit the present disclosure, application, or uses.

Figure 1:
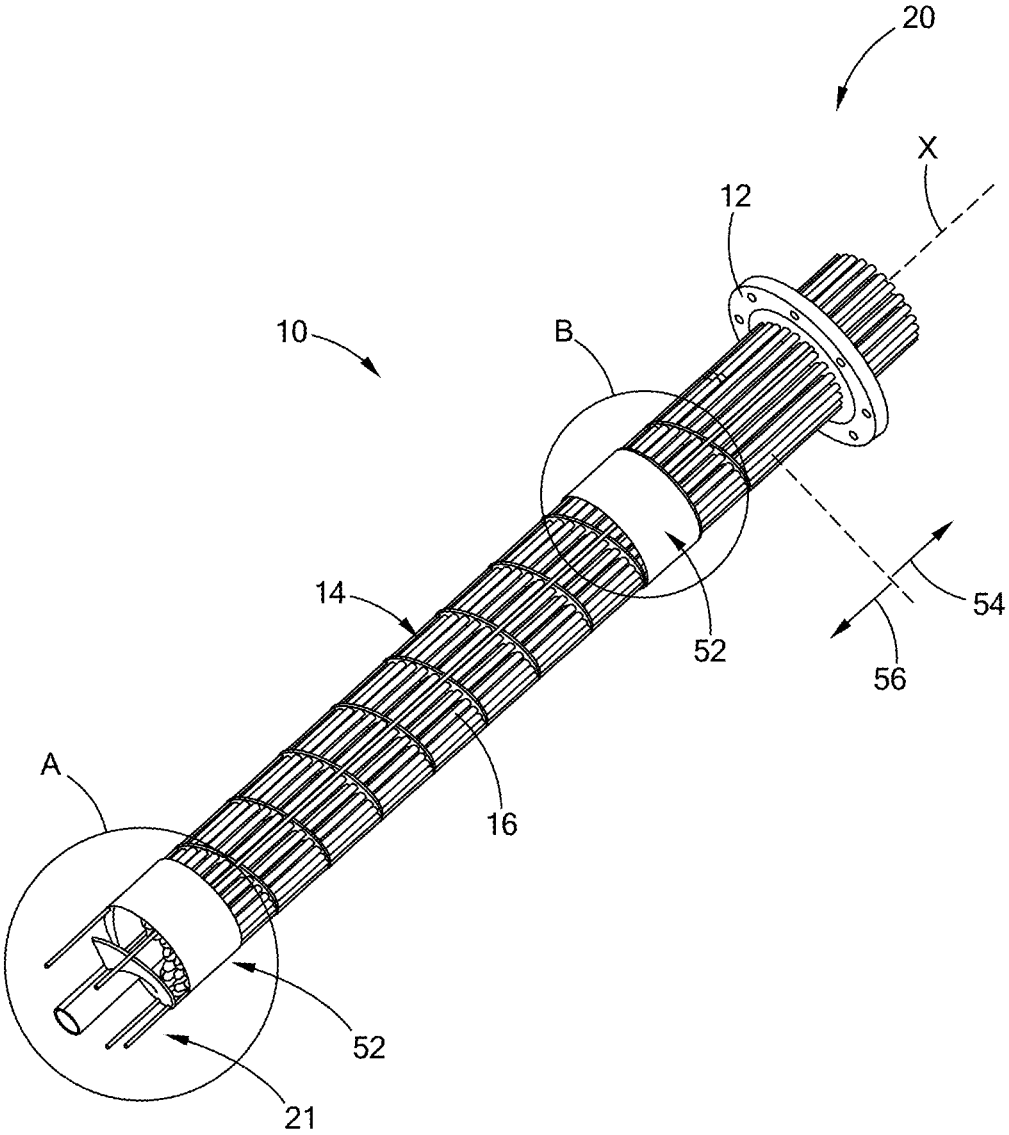
FIG. 1 is a perspective view of a heater assembly constructed in accordance with teachings of the present disclosure.

Referring to FIG. 1, a heater assembly 10 constructed in accordance with the teachings of the present disclosure is configured to be disposed inside a tubular body 82 or shell of a heat exchanger 80 (shown in FIGS. 16 and 17) to heat a working fluid flowing through the electric heat exchanger 80. The heater assembly 10 may be mounted to the tubular body 82 of the heat exchanger 80 by a proximal end plate or mounting flange 12. The heater assembly 10 includes a flow guiding device 14 and a plurality of heating elements 16 extending within and secured relative to the flow guiding device 14. The heater assembly 10 defines a proximal end portion 20 and a distal end portion 21 that define a longitudinal axis X of the heater assembly 10. The mounting flange 12 is disposed at the proximal end portion 20 of the heater assembly 10. The plurality of heating elements 16 extend along the longitudinal axis X of the heater assembly 10.

Figure 2:
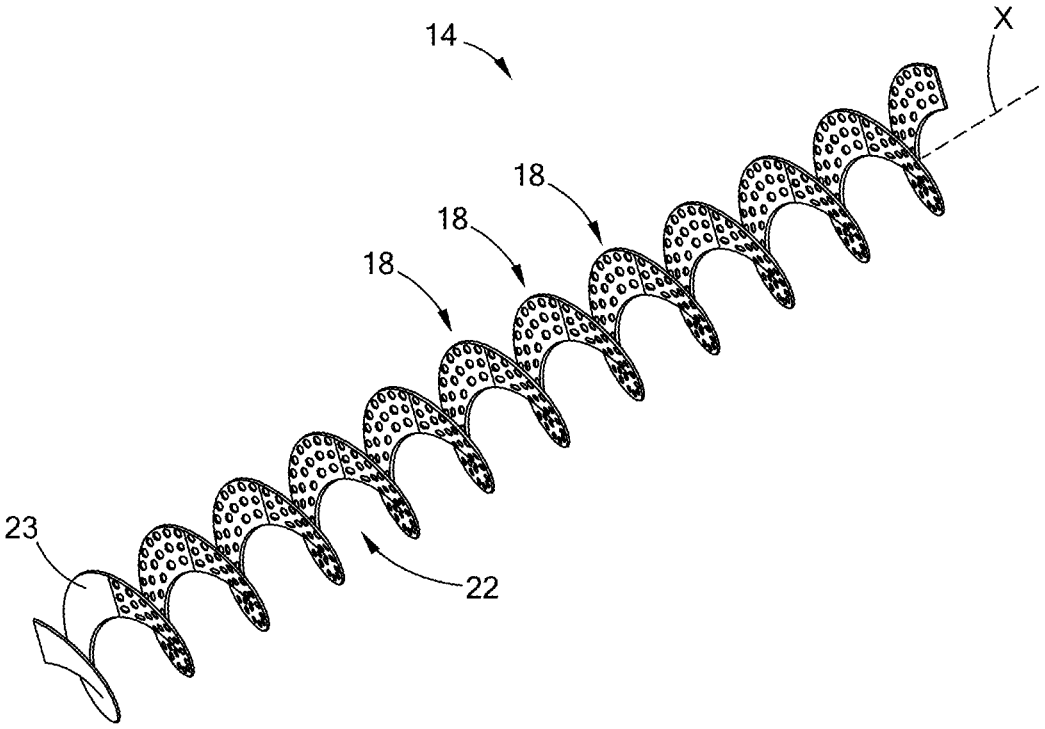
FIG. 2 is a perspective view of a continuous series of helical members of the heater assembly of FIG. 1.
Figure 16:
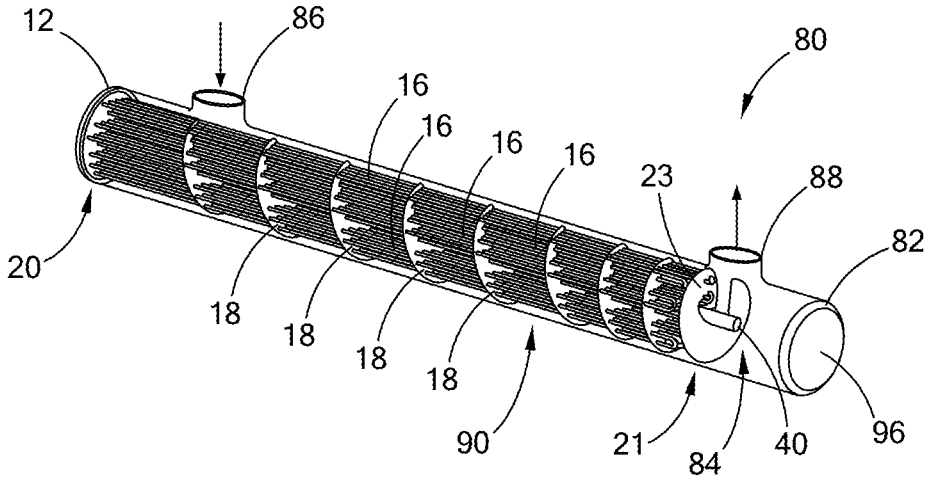
FIG. 16 is a cutaway perspective view of an electric heat exchanger constructed in accordance with the teachings of the present disclosure.
Figure 17:
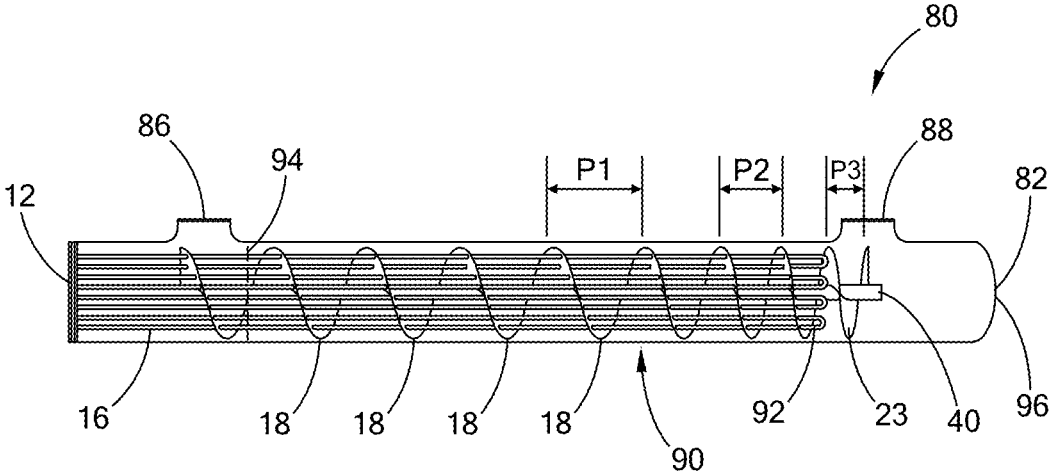
FIG. 17 is a cutaway front view of the electric heat exchanger of FIG. 16.

Referring to FIG. 2, the flow guiding device 14 includes a plurality of perforated helical members 18 or helical baffles that are connected in a linear array along the longitudinal axis X of the heater assembly 10 to define a continuous geometric helicoid. The continuous geometric helicoid is such that each perforated helical member 18 defines a surface that follows a helical path about the longitudinal axis X. Optionally, the flow guiding device 14 further includes a helical end baffle or non-perforated helical member 23 disposed adjacent to the distal end portion 21 of the heater assembly 10 and connected to an adjacent perforated helical member 18 to form an extension of the continuous geometric helicoid. The plurality of perforated helical members 18 and the non-perforated helical member 23 define a continuous helical flow guiding channel 22 to guide the working fluid to flow therein and to create a helical flow within the tubular body 82 of the heat exchanger 80 (FIGS. 16 and 17).

Figure 3:
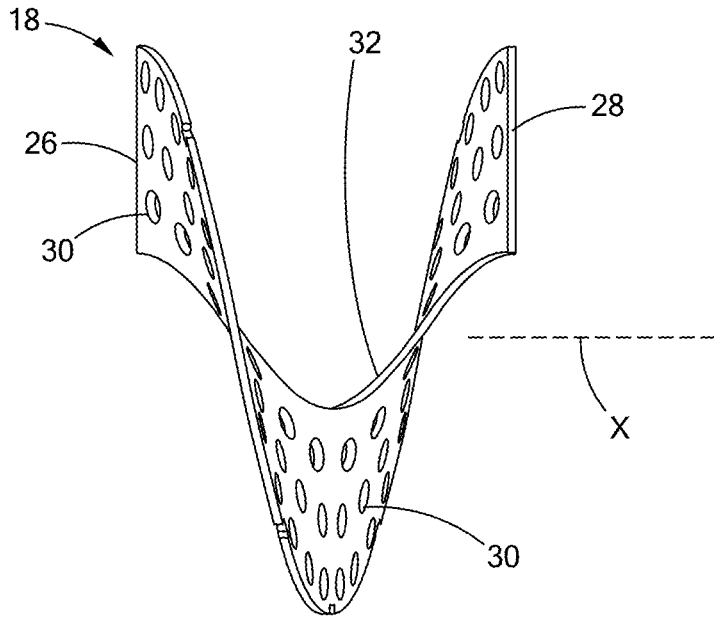
FIG. 3 is a perspective view of a helical member of FIG. 2.
Figure 4:
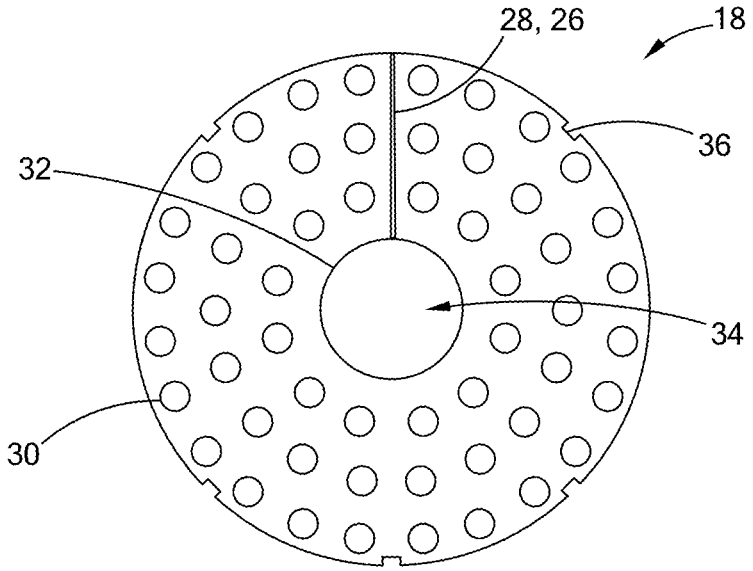
FIG. 4 is a front view of the helical member of FIG. 3.
Figure 6:
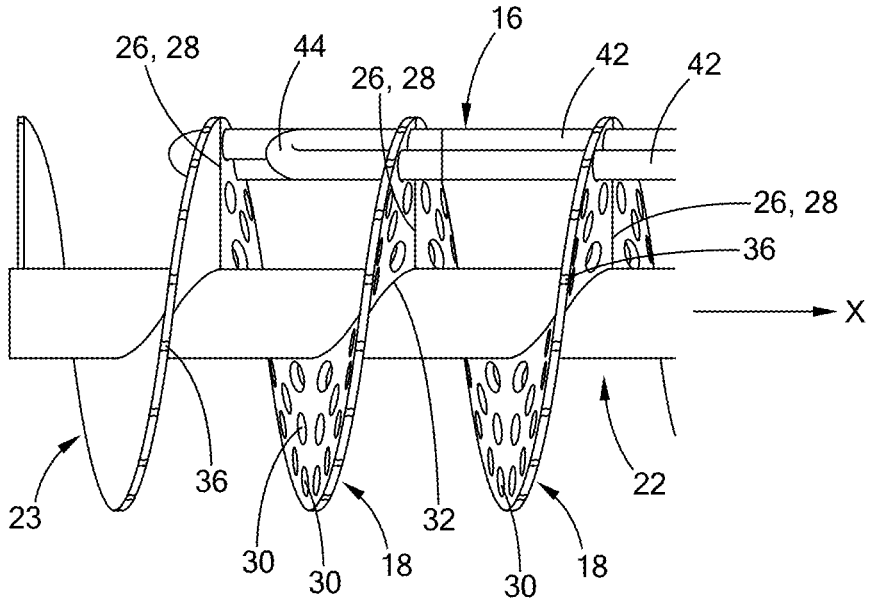
FIG. 6 is a partial perspective view of helical members and heating elements of FIG. 1.
Figure 8:
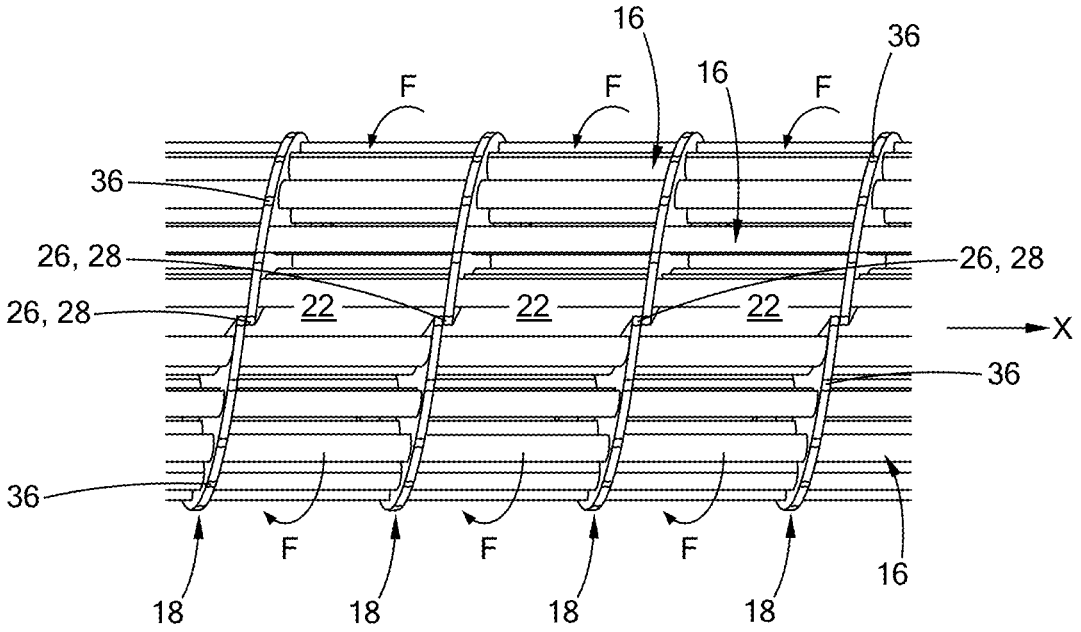
FIG. 8 is a partial perspective view of helical members and heating elements of FIG. 1.

Referring to FIGS. 3 and 4, the perforated helical members 18 each are in the form of a metal sheet that is bent to form one complete helical turn. While not shown in the drawings, it is understood that the metal sheet may be bent to form only a portion of one helical turn or more than one helical turn. The perforated helical members 18 each define opposed edges 26 and 28 and a predetermined pattern of perforations 30 extending through each perforated helical member 18. An opposed edge 26 or 28 from one perforated helical member 18 can be welded to an opposed edge 28 or 26 from an adjacent perforated helical member 18. In one form, as shown in FIG. 8, the opposed edge 26 or 28 of one perforated helical member 18 can overlap an opposed edge 28 or 26 from the adjacent perforated helical member 18. In the example shown in FIG. 8, this overlap is equal to about 1.01 rotations to provide additional coverage. In another form, as shown in FIG. 6, the opposed edge 26 or 28 from one perforated helical member 18 can abut and be welded to an opposed edge 28 or 26 from an adjacent perforated helical member 18 so that surfaces of the adjacent perforated helical members 18 form a continuous surface. In another example, not specifically shown, the opposed edge 26 or 28 from one perforated helical member 18 can be joined to the opposed edge 28 or 26 of the adjacent perforated helical member 18 by a bridging member (not shown). The bridging member can be helicoid in shape or can be another shape, such as extending a short distance in a circular manner for example.

Therefore, the perforated helical members 18 are connected along the longitudinal axis X of the heater assembly 10 to form a linear array (a continuous series) of the perforated helical members 18. The perforations 30 in the plurality of perforated helical members 18 are aligned along a direction parallel to the longitudinal axis X of the heater assembly 10, or normal to a radial direction, thus resulting in an angle relative to each face of the perforated helical members 18. The non-perforated helical member 23 is connected to a distal end of the continuous series of perforated helical members 18. The non-perforated helical member 23 is structurally similar to the perforated helical member 18, but is not perforated.

Each of the perforated helical members 18 and the non-perforated helical member 23 has an inner peripheral edge 32, which is contoured in a way such that when viewed in a direction parallel to the longitudinal axis X of the heater assembly 10, the inner peripheral edge 32 defines a circular aperture 34 coaxial with the longitudinal axis X. In the example provided, the perforated helical members 18 each define a plurality of peripheral grooves 36 along the outer periphery of the perforated helical members 18. Similarly, the non-perforated helical member 23 defines a plurality of peripheral grooves 36 along its outer periphery. The peripheral grooves 36 of the plurality of perforated helical members 18 (and the non-perforated helical member 23) are also aligned along a direction parallel to the longitudinal axis X of the heater assembly 10.

The helical pitch, the outer diameter of the perforated helical members 18, the diameter of the central aperture 34 of the perforated helical members 18 and the thickness of the perforated helical members 18 may be properly selected depending on a desired flow rate and a desired flow volume of the working fluid. The number of the heating elements 16 and the number of the perforations 30 in the perforated helical member 18 may be properly selected depending on a desired heat output and heat efficiency.

Figure 5:
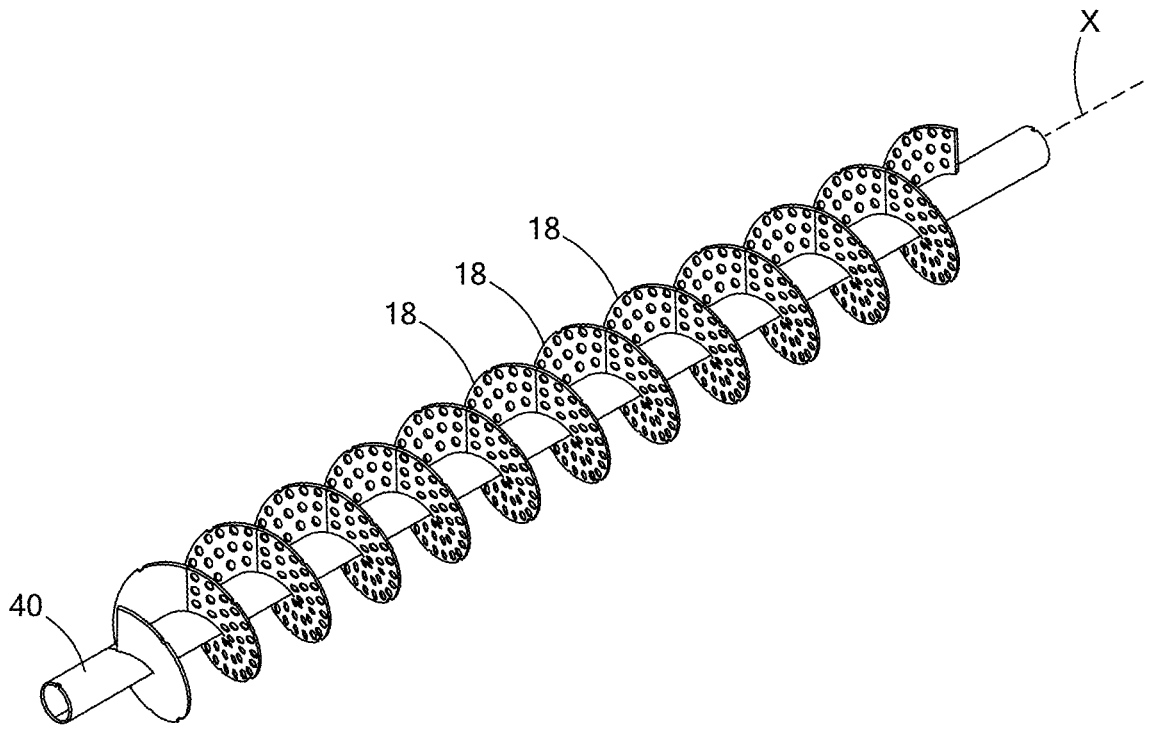
FIG. 5 is a perspective view of a continuous series of helical members and a central support member of FIG. 1.

Referring to FIG. 5, the heater assembly 10 further includes a central support member 40 that extends through the central apertures 34 of the perforated helical members 18 and the non-perforated helical member 23 to connect the plurality of perforated helical members 18 and the non-perforated helical member 23 together and to provide structural support for the heater assembly 10. The central support member 40 and the non-perforated helical member 23 may also be configured to provide additional heating to the working fluid. In one form, the central support member 40 is an additional heating element (e.g., an electric heating element). When also used as an additional heating element, the central support member 40 may include one or more electric resistance heating elements, such as a cartridge heater, a tubular heater or any conventional heater with an elongated configuration to provide both heating and structural support.

Figure 7:
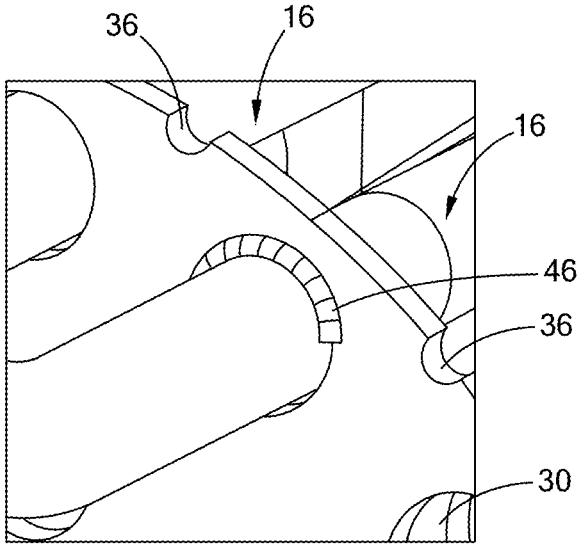
FIG. 7 is a view showing connection between a heating element and a helical member.

Referring to FIGS. 6 and 7, the plurality of heating elements 16 are inserted through the perforations 30. Only a couple heating elements 16 are shown in FIGS. 6 and 7 for clarity of illustration, but when fully assembled, all of the perforations 30 receive heating elements 16 therethrough, such that fluid travels along the helical flow guiding channel 22 and not through the perforations 30. In the example provided, the plurality of heating elements 16 each have a tongs-like configuration and includes a pair of straight portions 42 extending through the perforations 30 of the perforated helical members 18, and a bend portion 44 connecting the pair of straight portions 42. The heating elements 16 may be any suitable type of heating element, such as electric resistance heating elements.

For example, electric tubular heaters, electric cartridge heaters, or multi-cell heaters can be used. When the heating elements 16 are electric heating elements, they can contain resistance heating elements (e.g., heating coils, not specifically shown) that can be disposed within the straight portions 42 and, when included, the bend portion 44. In the example provided, an electric resistance heating coil can extend through the straight portions 42 and the bend portion 44 and have opposite leads (not specifically shown) extending from the proximal ends of respective straight portions 42. With additional reference to FIG. 29, one example of a cartridge-type heater is illustrated. In this example, the heating elements only include the straight portions 42. Each straight portion 42 is terminated at the distal end and the heating element 16 does not bend to connect to two of the straight portions 42. Instead, a resistance heating element (not shown) is disposed in each straight portion 42 and the electrical leads extend from the proximal end of each straight portion 42.

Returning to FIGS. 6 and 7, each of the heating elements 16 is secured to at least a portion of each perforation 30 through which each heating element 16 extends. In the example provided, the heating elements 16 are secured by welding over approximately one-half of a periphery of each perforation 30 so that a weld joint 46 is formed along half periphery of the perforation 30.

Referring to FIG. 8, the working fluid is guided by the perforated helical members 18 in the flow guiding channel 22 to flow in a helical direction F and is continuously heated by the heating elements 16. By using the flow guiding channel 22, the working fluid can be guided to flow transversely across the heating surface of the heating elements 16. Therefore, the working fluid can be more efficiently heated by the heating elements 16 within a predetermined length of the heat exchanger 80, as opposed to a typical heat exchanger (not shown) where the working fluid flows in a direction parallel to the longitudinal axis X of the heat exchanger. Because the working fluid is properly guided to flow transversely across the heating surface of the heating elements 16, a dead zone where the working fluid is not heated can be avoided. In traditional heat exchangers, not specifically shown, dead zones can lead to fouling in which the working fluid breaks down and causes material buildup and deposits on the heating elements. Accordingly, the heat exchangers of the present teachings can reduce fouling and increase heat transfer efficiency by increasing flow uniformity and decreasing the radiative heat loss to the shell or vessel (e.g., body 82 shown in FIGS. 16 and 17).

Figure 9:
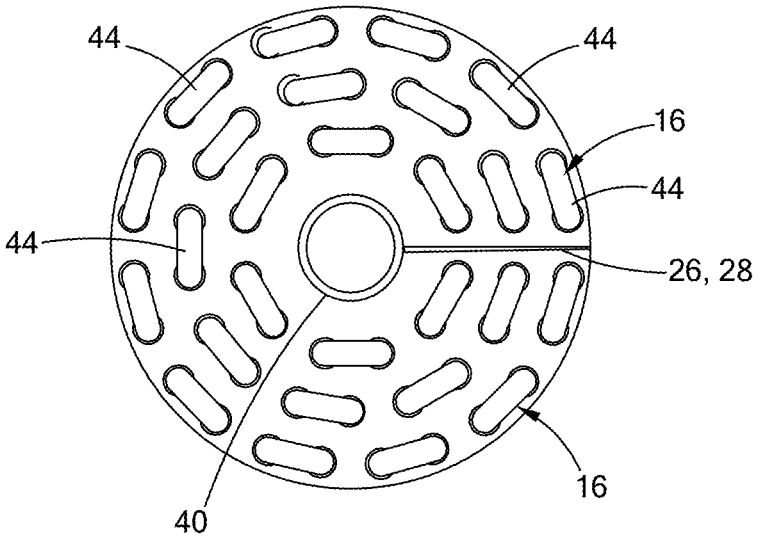
FIG. 9 is a front view of heating elements mounted to a helical member.
Figure 10:
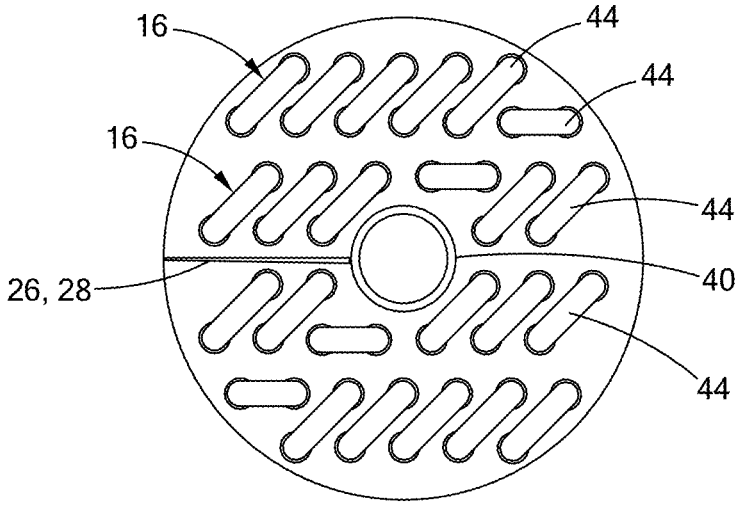
FIG. 10 is a front view of heating elements mounted to a helical member showing a different arrangement of the heating elements.
Figure 12:
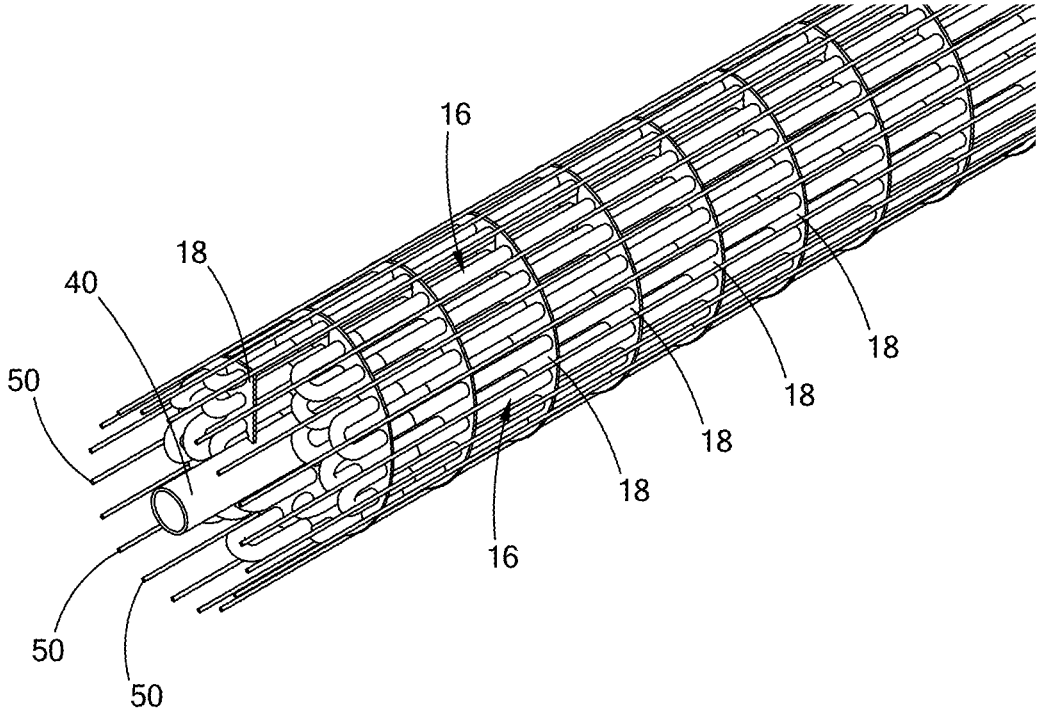
FIG. 12 is a partial perspective view of a heater assembly of FIG. 1, with a shroud and a non-perforated helical member removed.

Referring to FIGS. 9 and 10, the heating elements 16 may be inserted into the perforations 30 in a way such that the bend portion 44 of the heating elements 16 form a concentric pattern around the central support member 40 (FIG. 9), or to form a symmetric pattern relative to a diameter of the perforated helical member 18 (FIG. 10). Between the configurations shown in FIGS. 9 and 10, a greater density of heating elements 16 can be fit in the same space using the concentric pattern, though other configurations and patterns can be used. Between the configurations shown in FIGS. 9 and 10, the concentric pattern generally has tighter bend radii connecting the straight portions 42. Thus, the pattern can also be chosen based on design criteria, such as element density or bend radii. As best shown in FIG. 12, the heating elements 16 can have different lengths, such that some of the heating elements 16 extend further along the longitudinal axis X than others. The length of the heating elements 16 can be based on their location relative to the non-perforated helical member 23. In one configuration, the one or more of the heating elements 16 can be a first set of heating elements that all have a first length, while one or more different heating elements 16 can be a second set of heating elements that all have a second length that is different from the first length. In this example, the heating elements 16 are not limited to only two sets with only two lengths, and additional sets and lengths can be included.

Figure 30:
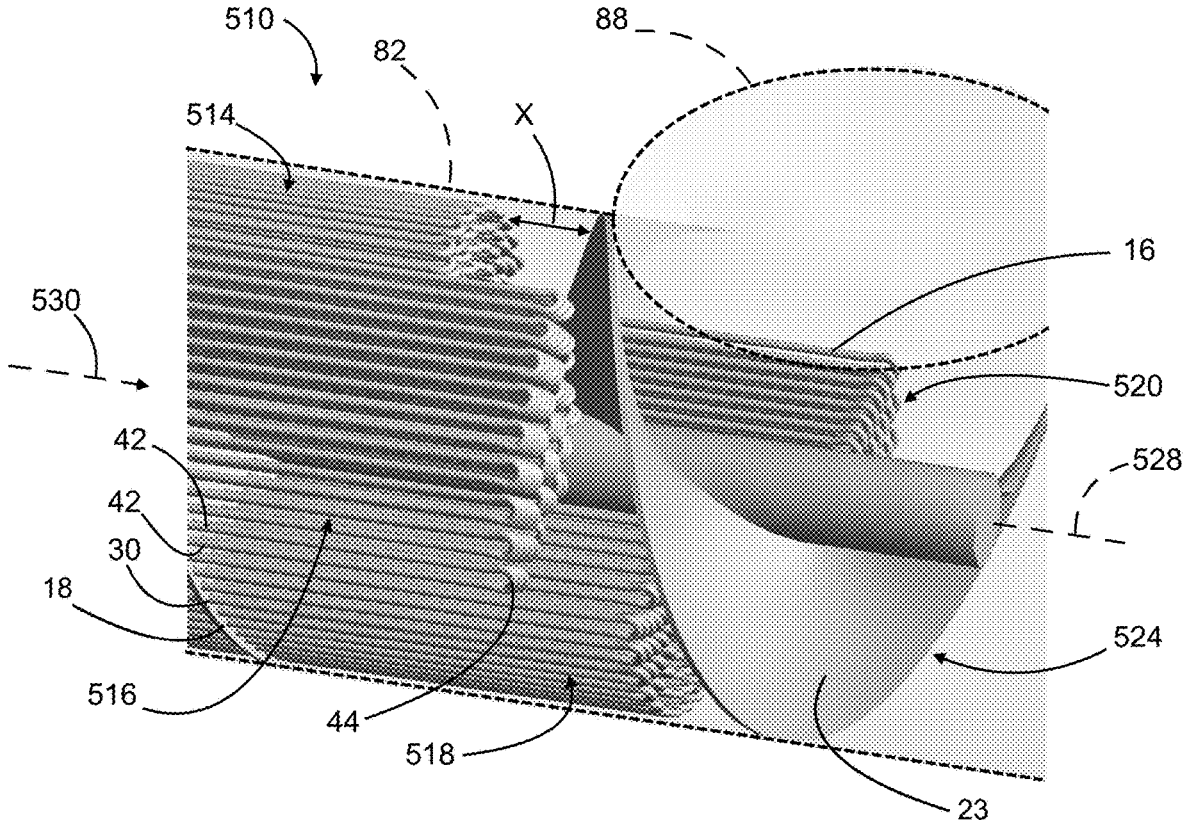
FIG. 30 is a perspective view of an end portion of a heater assembly of a fourth construction in accordance with the teachings of the present disclosure.

In one configuration, shown in FIG. 30, a heater 510 includes four sets 514, 516, 518, and 520 of heating elements 16, though more or fewer sets can be used. The heater 510 is similar to the heater 10 except as otherwise shown or described herein. Accordingly, similar numbers represent similar features, the details of which are not repeated herein. As such, the heater 510 includes a flow guide 524 that defines a continuous geometric helicoid disposed about a longitudinal axis 528 of the heater assembly.

The flow guide 524 defines a predetermined pattern of perforations 30 that extend in a longitudinal direction 530 through a first longitudinal length of the geometric helicoid, the longitudinal direction 530 being parallel to the longitudinal axis 528. The first longitudinal length is less than a full longitudinal length of the geometric helicoid of the flow guide 524 such that a distal portion of the geometric helicoid lacks the perforations 30.

The flow guide 524 can be optionally constructed by individual perforated helical members (similar to the perforated helical members 18) and one or more non-perforated helical members (similar to non-perforated helical member 23) that are arranged and connected as discussed above with reference to the perforated helical members 18 and non-perforated helical member 23.

Each heating element 16 of a particular set 514, 516, 518, or 520 has the same length as the other heating elements 16 of that set 514, 516, 518, or 520. In other words, each heating element 16 of a particular set 514, 516, 518, 520 terminates at the same distance from the flange 12 (FIG. 1) as the other heating elements 16 of that same set 514, 516, 518, 520.

In the example provided, the heating elements 16 of each set 514, 516, 518, 520 have straight portions 42 connected at their distal ends by bend portions 44. In an alternative configuration, not specifically shown, the heating elements 16 of each set 514, 516, 518, 520 can have only straight portions 42 that terminate at closed distal ends, similar to closed ends 314 shown in FIG. 29 or 31.

Returning to the example of FIG. 30, each set 514, 516, 518, 520 has the same or approximately the same number of heating elements 16. For example, the sets 514, 516, 518, 520 may differ in number of heating elements 16 by plus or minus five heating elements 16. Thus, in the example provided, each set 514, 516, 518, 520 is or is approximately one quadrant of the total arrangement of heating elements 16 disposed about the longitudinal axis 528.

For each electrical resistance heating element 16, a length of that electrical resistance heating element 16 and a pitch of the geometric helicoid at a distal end of that electrical resistance heating element 16 are such that the distal end of that electrical resistance heating element 16 is a distance X of the geometric helicoid at the distal end of that electrical resistance heating element, wherein the distance X is taken along the longitudinal direction. The distance X must be sufficient to account for thermal expansion. In one form, the distance X is at least 0.5 inches (12.7 mm). In one form, the distance X is less than or equal to 40% of the pitch of the geometric helicoid at the distal end of that electrical resistance heating element. In another form, the distance X is less than or equal to 10% the distance in the longitudinal direction between the last perforated helical baffle 18 and the non-perforated helical baffle 23.

The distal ends of the set 520 of electrical resistance heating elements 16 are disposed farther along the helical flow path than the distal ends of the set 518, the distal ends of the set 518 are disposed farther along the helical flow path than the distal ends of the set 516, and the distal ends of the set 516 are disposed farther along the helical flow path than the distal ends of the set 514. In other words, the set 520 of electrical resistance heating elements 16 extends farther in the longitudinal direction 530 than the set 518, the set 518 extends farther in the longitudinal direction 530 than the set 516, and the set 516 extends farther in the longitudinal direction 530 than the set 514.

In the example provided, the tubular body 82 includes an inlet/outlet 86 (shown in FIGS. 16, 17, 26, and 27) open into an interior of the tubular body 82 at a first end portion of the tubular body 82, and an inlet/outlet 88 open into the interior of the tubular body 82 at a second end portion of the tubular body that is farther in the longitudinal direction 530 than the inlet/outlet 86. The distinct sets 514, 516, 518, 520 of electrical resistance heating elements 16 are arranged such that the sets 514, 516, 518, 520 progressively extend farther in the longitudinal direction 530 with increased position along the helical flow path defined by the flow guide 524 within the tubular body 82.

In the example provided, the set 520 overlaps in the longitudinal direction 530 with the inlet/outlet 88. In one form, the set 514 of electrical resistance heating elements 16 do not overlap in the longitudinal direction 530 with the inlet/outlet 88. In one form, the set 516 of electrical resistance heating elements 16 do not overlap in the longitudinal direction 530 with the inlet/outlet 88. In one form, the set 518 of electrical resistance heating elements 16 do not overlap in the longitudinal direction 530 with the inlet/outlet 88.

In an alternative form, not specifically shown, the set 520 can terminate before the inlet/outlet 88 such that the set 520 do not overlap in the longitudinal direction 530 with the inlet/outlet 88.

In the example provided, the non-perforated region of the flow guide 524 is positioned such that none of the electrical resistance heating elements 16 terminates in a region of the helical flow pathway that is rotationally beyond the inlet/outlet 88. In other words, none of the electrical resistance heating elements 16 are located in the low pressure region, formed when the bulk of the fluid flow exits the flow guide and flows directly to through the inlet/outlet 88, that is rotationally after the inlet/outlet 88 and/or further in the longitudinal direction 530 than the inlet/outlet 88.

In the example provided in FIG. 30, the flow guide 524 is a right-handed helicoid such that the fluid flows in a counter-clockwise direction when viewed from the opposite direction as the longitudinal direction 530 (i.e., viewed from inlet/outlet 88 toward the inlet/outlet 86), though a left-handed helicoid can be used.

In the example provided, the flow guide 524 has a pitch similar in length to the diameter of the inlet/outlet 88. Thus, if any of the electrical resistance heating elements 16 align in the longitudinal direction 530 with the inlet/outlet 88, then none of the electrical resistance heating elements 16 terminate further rotationally in the flow direction than a 12 O'clock when viewed from the opposite direction as the longitudinal direction 530 with the inlet/outlet 88 at 12

O'clock. In the example provided, the set 520 of electrical resistance heating elements 16 terminates at approximately 3 O'clock, though other rotational locations can be used.

Figure 32:
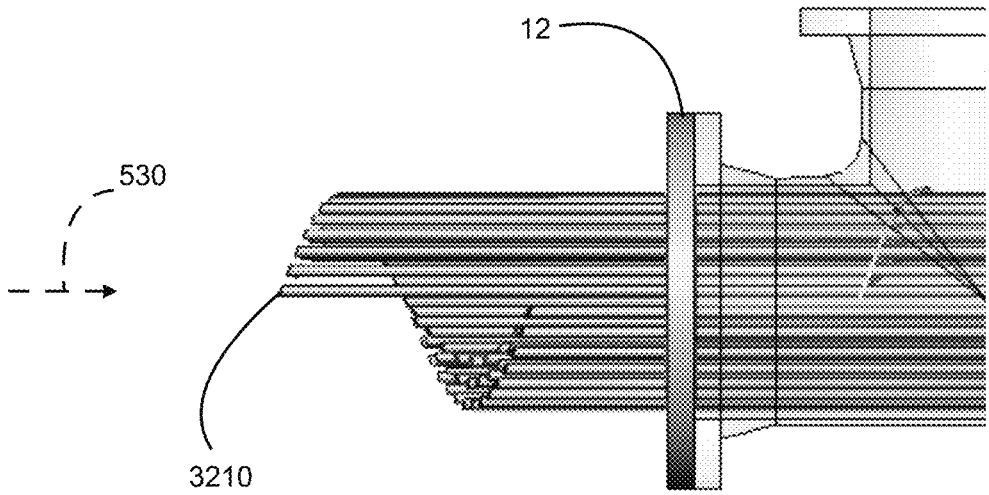
FIG. 32 is a side partial cross-sectional view of an opposite end portion of the heater assembly of FIG. 31.

With continued reference to FIG. 30 and additional reference to FIG. 32, each heating element 16 can be the same total length. Thus, the opposite ends 3210 of the heating elements 16 do not all extend the same distance from the mounting flange 12 in the direction that is opposite the longitudinal direction 530. In other words, the opposite ends 3210 of the heating elements 16 can be at different axial positions relative to each other. The axial positions of the opposite ends 3210 can correlate to the axial positions of the ends 314. In an alternative configuration, the heating elements 16 can be different total lengths such that the opposite ends all end at the same distance from the mounting flange 12, similar to that shown in FIG. 1.

Figure 23:
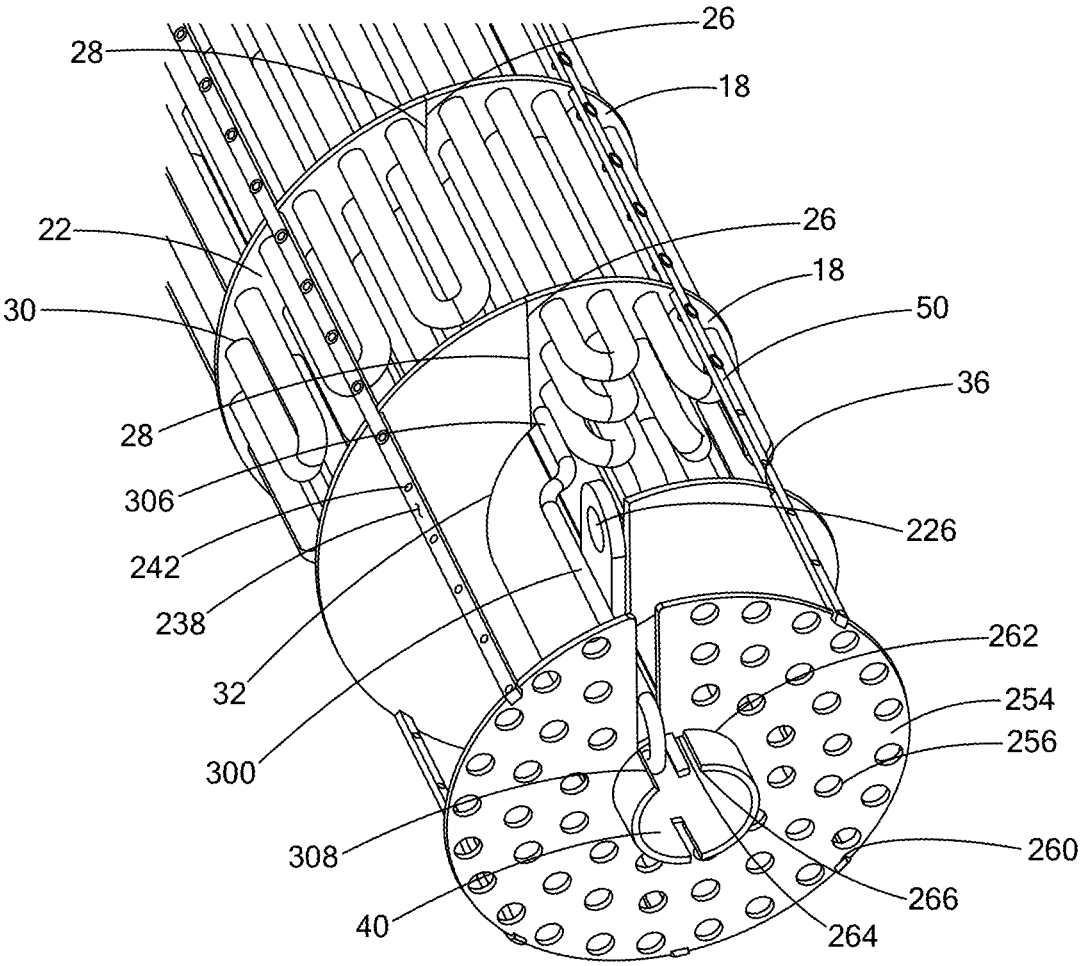
FIG. 23 is a perspective view of a distal end of the heater assembly of FIG. 20.
Figure 28:
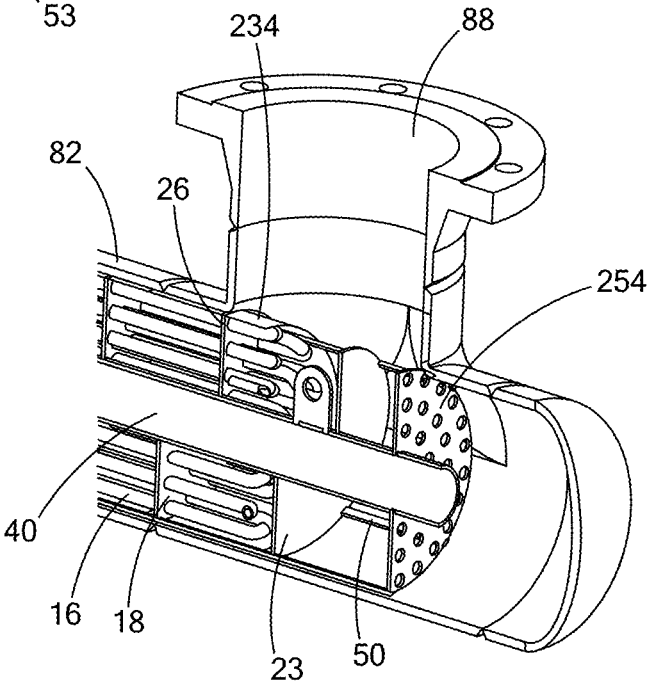
FIG. 28 is a cross-sectional view of a distal end of the heat exchanger of FIG. 26.
Figure 29:
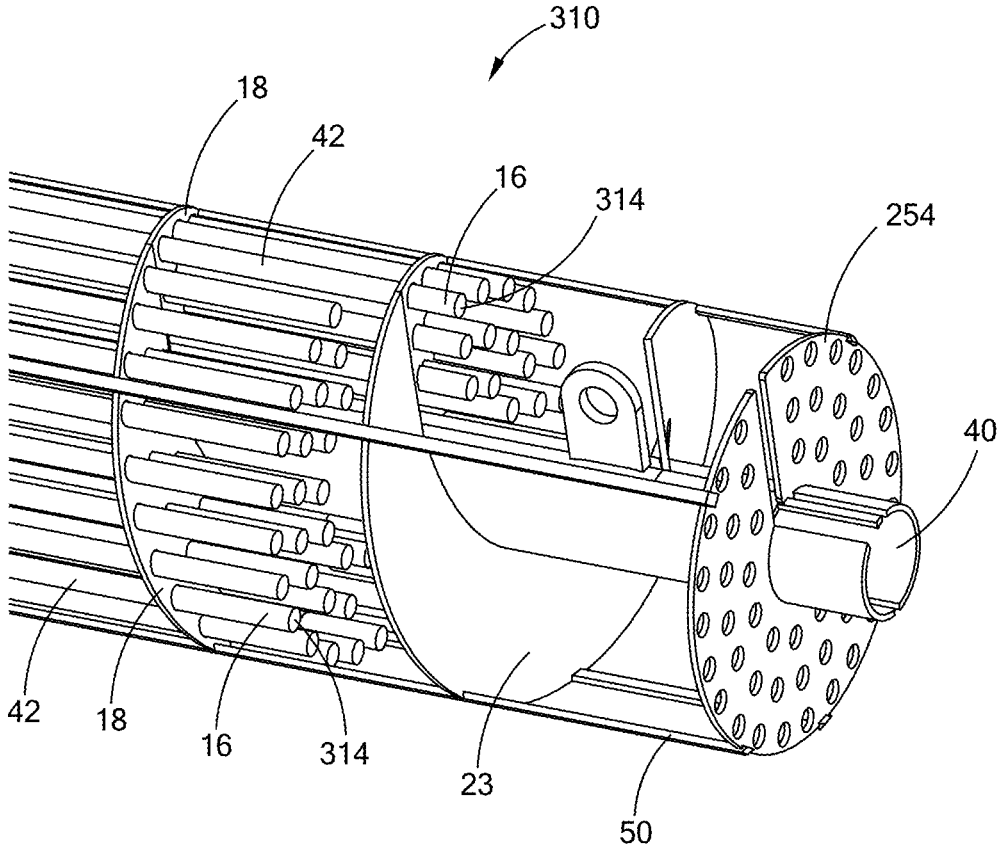
FIG. 29 is a perspective view of a heater assembly of a third construction in accordance with the teachings of the present disclosure, illustrating straight heating elements.
Figure 31:
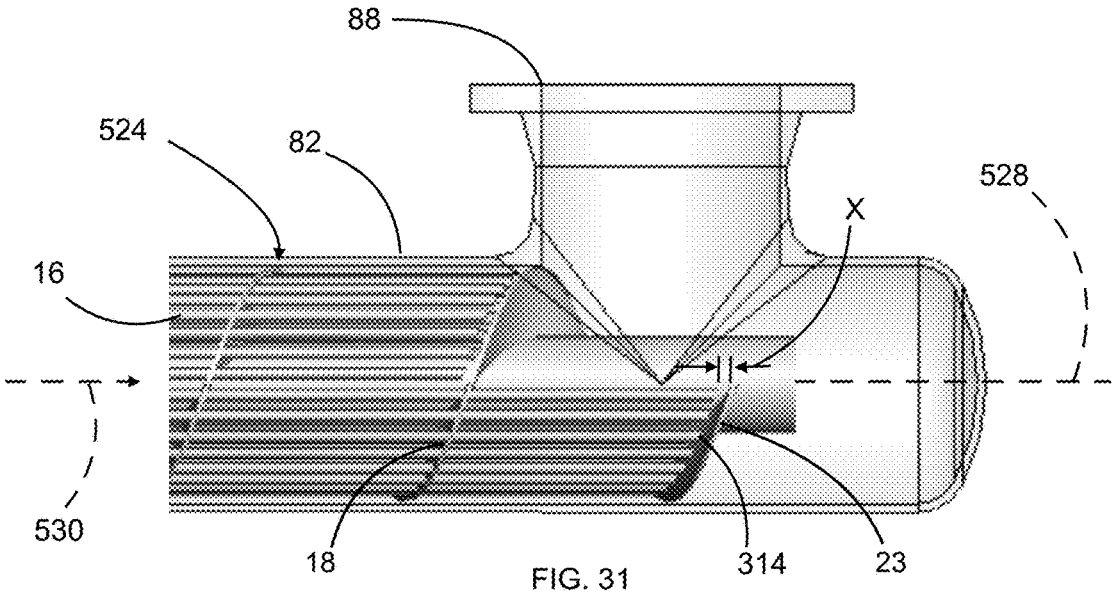
FIG. 31 is a side partial cross-sectional view of an end portion of a heater assembly of a fifth construction in accordance with the teachings of the present disclosure.
Figure 33:
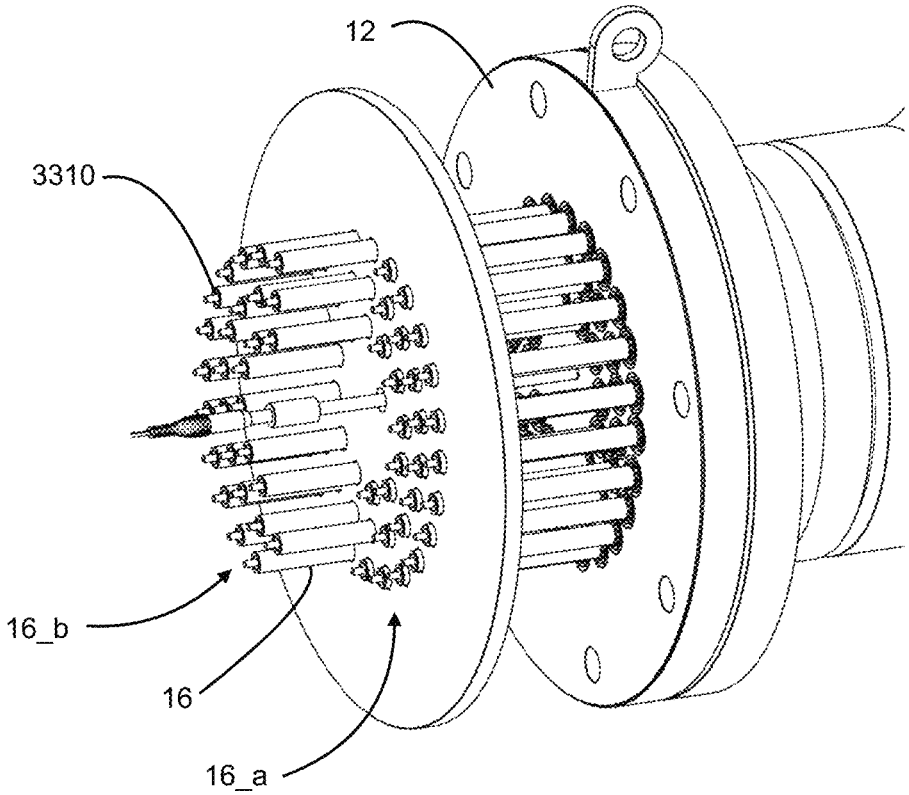
FIG. 33 is a perspective view of an opposite end portion of the heater assembly of FIG. 30.

While FIG. 32 illustrates the opposite ends 3210 of each straight heating element 16 of FIG. 31 being at different positions, FIG. 33 illustrates opposite ends 3310 of a heater of an alternative configuration where there is a first group of heating elements 16_*a* and a second group of heating elements 16_*b*, similar to that shown in FIGS. 23 and 28 or 29. Each heating element 16 in the first group of heating elements 16_*a* are all of the same total length as each heating element 16 in the second group of heating elements 16_*b* but the opposite ends 3310 are located at different axial positions relative to the mounting flange 12 corresponding to the axial positions of the bends 44 (FIG. 6) or ends 314 (FIG. 29). While two groups of heating elements 16 are illustrated, it more than two groups can be used. For example, the four groups of heating elements 16 of FIG. 30 may optionally be all the same total length such that their opposite ends (not specifically shown) extend different distances from the mounting flange (not specifically shown).

Figure 34:
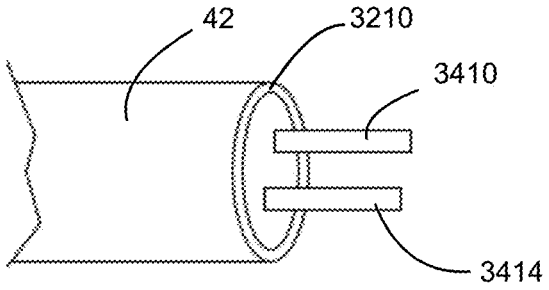
FIG. 34 is a perspective view of an end portion of a heater element in accordance with one form of the present disclosure.
Figure 35:
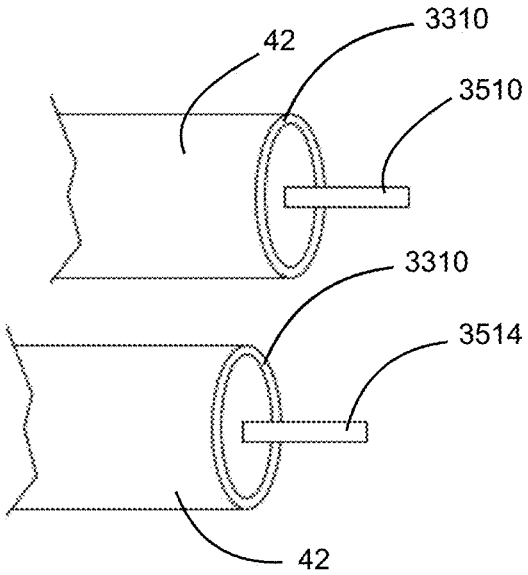
FIG. 35 is perspective view of an end portion of a heater element in accordance with another form of the present disclosure.

In the constructions described herein with a single straight portion 42 (e.g., FIGS. 29 and 31) instead of a bend 44 (e.g., FIGS. 1 and 30), the opposite end 3210 of each heating element 16 has a pair of leads or terminal pins 3410, 3414 (shown in FIG. 34) configured to receive electrical power. In the constructions described herein as having two straight portions 42 per heating element (e.g., FIGS. 1 and 30), the opposite end 3310 of each straight portion 42 includes a lead or terminal pin 3510, 3514 (FIG. 35) configured to receive electrical power. Accordingly, in configurations where the opposite ends 3210, 3310 do not all end at the same axial position, the connections to electrical power via the terminal pins 3410, 3414 or 3510, 3514 within a junction box such as 2610 (shown in FIG. 26) are not all at the same axial position within the junction box 2610.

In another configuration, shown in FIG. 31, the electrical resistance heating elements 16 are straight and terminate at their distal ends 314 similar to FIG. 29 except that electrical resistance heating elements 16 are of lengths such that the distal ends 314 follow closely to the shape of the non-perforated region of the flow guide 524. In other words, the distance X is less than or equal to 10% of the pitch of the geometric helicoid at the distal end 314 of any particular electrical resistance heating element 16.

In one form, the electrical resistance heating elements 16 can all have different lengths. In another form, electrical resistance heating elements 16 that are aligned along a radius line (that extends from the longitudinal axis 528 radially outward) can have the same length to form discrete sets.

In the example provided in FIG. 31, the flow guide 524 is a left-handed helicoid such that the fluid flows in a clockwise direction when viewed from the opposite direction as the longitudinal direction 530 (i.e., viewed from inlet/outlet 88 toward the inlet/outlet 86), though a right-handed helicoid can be used.

In the example provided, the flow guide 524 has a pitch similar in length to the diameter of the inlet/outlet 88. Thus, if any of the electrical resistance heating elements 16 align in the longitudinal direction 530 with the inlet/outlet 88, then none of the electrical resistance heating elements 16 terminate further rotationally in the flow direction than a 12 O'clock when viewed from the opposite direction as the longitudinal direction 530 with the inlet/outlet 88 at 12 O'clock. In the example provided, none of the electrical resistance heating elements 16 terminate rotationally beyond approximately 9 O'clock, though other rotational locations can be used.

Figure 11:
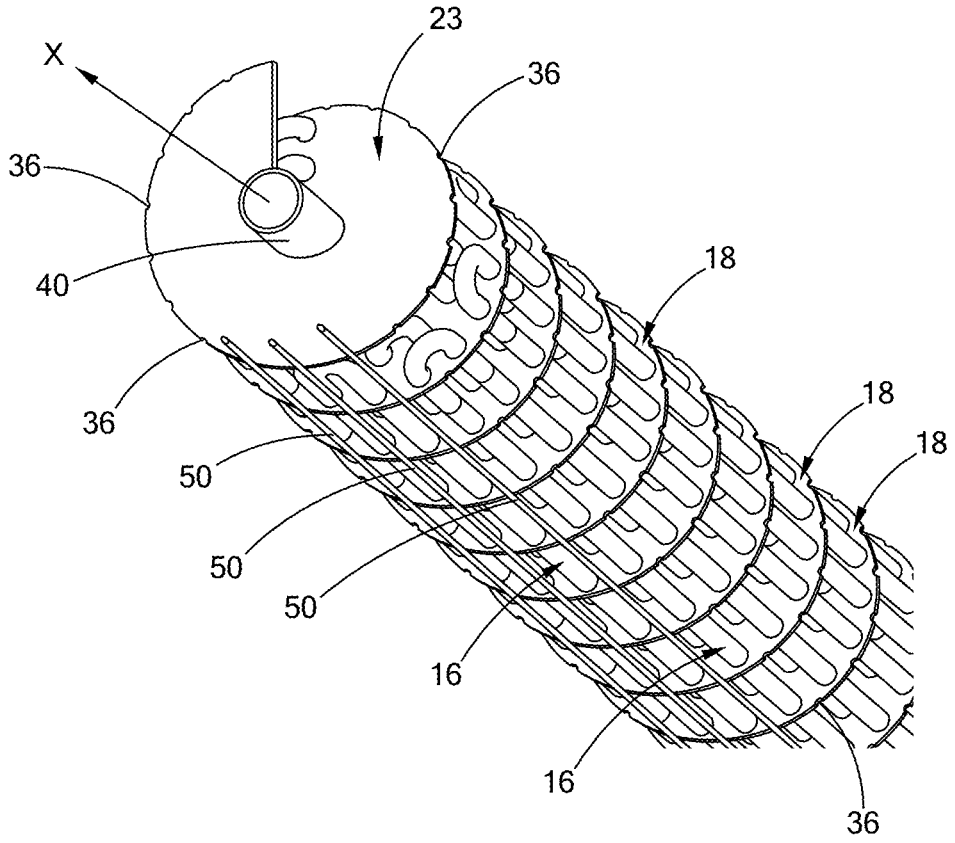
FIG. 11 is a partial perspective view of a heater assembly of FIG. 1, with a shroud removed to show a non-perforated helical member and support rods.

Referring to FIGS. 11 and 12, the heater assembly 10 can further include a plurality of support rods 50 extending through the peripheral grooves 36 of the perforated helical members 18 and the non-perforated helical member 23 and parallel to the longitudinal axis X of the heater assembly 10. The support rods 50 may extend outward (i.e., in the radial direction relative to the longitudinal axis X) beyond a periphery of the peripheral grooves 36 and may be configured as glide rods for installation of the heater assembly 10 into a cylindrical cavity 84 of the tubular body 82 of the heat exchanger 80 (FIGS. 16 and 17). In other words, the support rods 50 can reduce the direct surface contact between the heater assembly 10 and the inner wall of the tubular body 82 (FIGS. 16 and 17) to reduce friction and, thus, the force needed to slide the heater assembly 10 into the tubular body 82. Alternatively, the support rods 50 may be configured to not extend beyond a periphery of the peripheral grooves 36 and merely function as a structural support for the heater assembly 10. In the example provided, the support rods 50 are welded to the perforated helical members 18 and the non-perforated helical member 23.

Referring back to FIG. 1, the heater assembly 10 may further include a pair of shrouds 52 that are provided at the proximal end portion 20 and the distal end portion 21 for surrounding the perforated helical members 18, the non-perforated helical member 23, the heating elements 16, and the support rods 50. At the proximal end, the shroud 52 is generally located between an unheated portion 54 and a heated portion 56. While FIG. 1 shows two shrouds 52, any number of shrouds 52, including one, may be provided to surround the perforated helical members 18, the heating elements 16, and the support rods 50. When one shroud 52 is provided, the shroud 52 may be provided at the distal end portion 21 or the proximal end 20.

Figure 13:
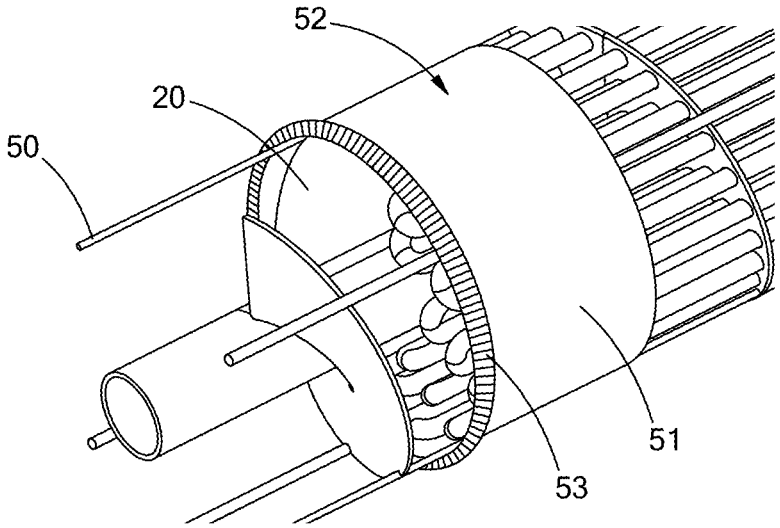
FIG. 13 is an enlarged view of portion A of FIG. 1.
Figure 14:
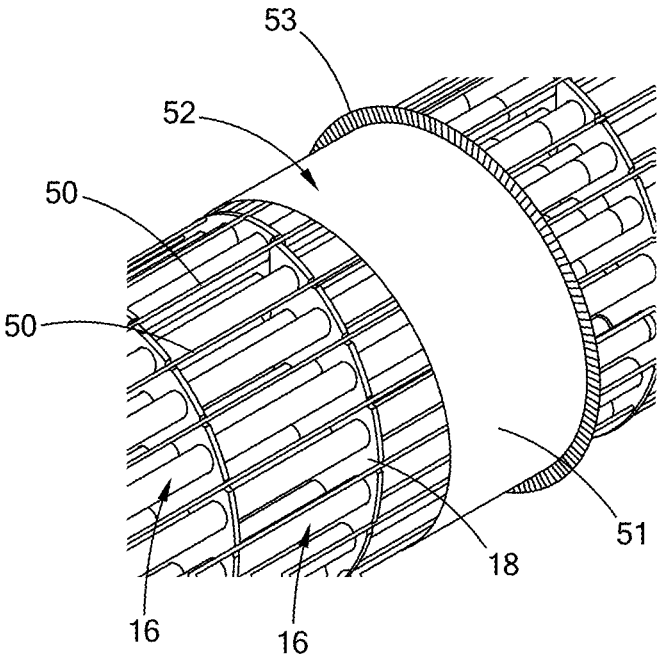
FIG. 14 is an enlarged view of portion B of FIG. 1.

Referring to FIGS. 13 and 14, the shrouds 52 can each define a cylindrical shroud member 51 and a plurality of deformable flaps 53 that form a skirt about the cylindrical shroud member 51. The cylindrical shroud member 51 can wrap a portion of the perforated and/or non-perforated helical members 18, 23. In the example provided, each cylindrical shroud member 51 extends along the longitudinal axis X a length that is at least one full helical pitch of the corresponding perforated or non-perforated helical members 18, 23 that it surrounds. The deformable flaps 53 are generally formed by cutting a radially outward flanged portion of the shroud 52 such that the flaps 53 can extend radially outward from the cylindrical shroud member 51. Contact with the inner wall of the tubular body 82 can elastically deform the flaps 53 such that the flaps 53 are biased into contact with the inner wall of the tubular body 82 to inhibit flow from escaping between the tubular body 82 of the heat exchanger 80, thus mitigating blow-by. In the example provided, the flaps 53 of the distal shroud 52 shown in FIG. 13 can be positioned axially near the distal end of the heater assembly 10, such as just before an outlet 88 of the tubular body 82 of the heat exchanger 80. For example, the flaps 53 of the distal shroud 52 can be positioned approximately at dashed line 92 shown in FIG. 17 before the outlet 88 of the tubular body 82. In the example provided, the flaps 53 of the proximal shroud 52 shown in FIG. 14 can be positioned axially near the start of the perforated helical members 18 such as after an inlet 86 of the tubular body 82. For example, the flaps 53 of the proximal shroud 52 can be positioned approximately at dashed line 94 shown in FIG. 17 after the inlet 86 of the tubular body 82.

Figure 15:
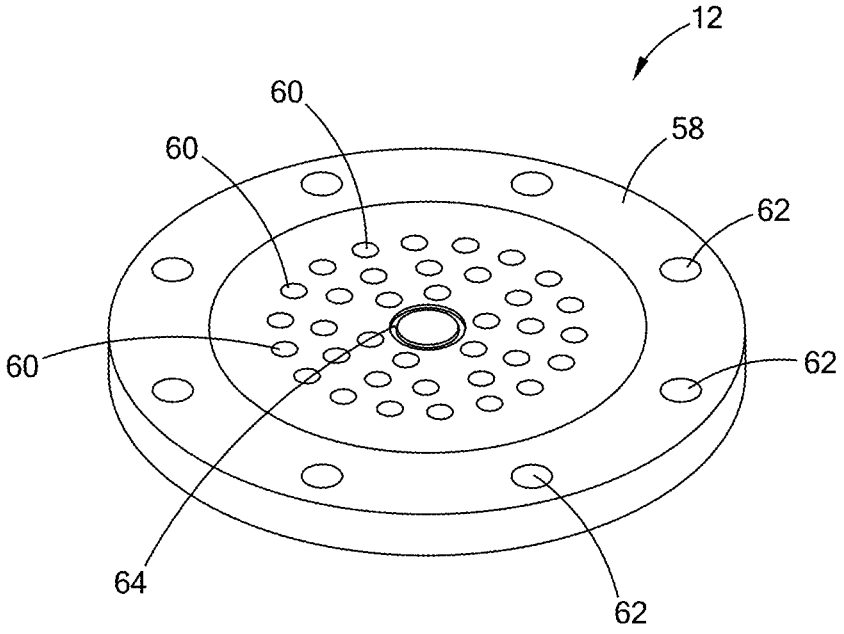
FIG. 15 is a perspective view of a proximal mounting flange of FIG. 1.

Referring to FIG. 15, the proximal mounting flange 12 is configured to secure the heater assembly 10 to a tubular body 82 of the heat exchanger 80. The proximal mounting flange 12 includes a plate body 58, a plurality of apertures 60 and a plurality of bolt holes 62 through the plate body 58. The plurality of apertures 60 are aligned with the perforations 30 of the continuous series of perforated helical members 18 and are configured to route the plurality of heating elements 16 through the proximal mounting flange 12. While not specifically shown, the heating elements 16 can be sealed to the apertures 60 so that fluid is prevented from flowing through the apertures 60. The plurality of bolt holes 62 are defined along the periphery of the plate body 58. The proximal mounting flange 12 may be mounted to the tubular body 82 of the heat exchanger by inserting bolts (not shown) into the bolt holes 62 and through bolt holes in a mating flange (e.g., mating flange 83 shown in FIG. 26) of the tubular body 82. A gasket (not shown) or other sealing material can be used to form a fluid-tight seal between the mounting flange 12 and the mating flange (e.g., flange 83 shown in FIG. 26). In another configuration, not shown, the end plate or mounting flange 12 can be mechanically attached to the mating flange by a different manner, such as welding, latches, clamps, etc.

The proximal mounting flange 12 can further define a circular central recess or groove 64 configured to align the central support member 40. The central groove 64 is coaxial with the longitudinal axis X and a proximal end of the central support member 40 is configured to be received in the central groove 64. In the example provided, the central support member 40 is welded to the proximal mounting flange 12.

Referring to FIGS. 16 and 17, the heat exchanger 80 configured in accordance with the teachings of the present disclosure includes the tubular body or shell 82 defining the cylindrical cavity 84, the inlet 86, the outlet 88, and a heater assembly 90 disposed inside the tubular body 82. The heater assembly 90 defines a proximal end portion 20 and a distal end portion 21. A proximal mounting flange 12 is configured to secure the heater assembly 90 to the body 82.

The heater assembly 90 is structurally similar to that of FIG. 1 except that the continuous series of perforated helical members 18 and the non-perforated helical member 23 are connected in a way such that the helicoid defined by the perforated helical members 18 and the non-perforated helical member 23 has a variable pitch. Therefore, like elements are indicated by like reference numbers and the detailed description thereof is omitted herein for clarity. In the example provided, the outlet 88 is a radial outlet such that it is open to the flow path 22 through the radial direction. In an alternative configuration, not specifically shown, the outlet 88 can be an axial end outlet that is open through an axial end 96 of the body 82.

Returning to the example provided, the helicoid defined by the perforated helical members 18 and the non-perforated helical member 23 may have a pitch which is the largest at the proximal end portion 20 (near the inlet 86 of the heat exchanger 80) and the smallest at the distal end portion 21 (near the outlet 88 of the heat exchanger 80). In one form, the pitch is a continuously varying pitch with the pitch gradually decreasing from the proximal end portion 20 to the distal end portion 21. Alternatively, as shown in FIG. 17, the heater assembly 90 may define a plurality of zones along the longitudinal axis X of the heater assembly 90. The pitch can be fixed within a particular zone, while different zones can have different pitches. For example, the heater assembly 90 may define three heating zones with a first fixed pitch P1 in the first zone, a second fixed pitch P2 in the second zone, and a third fixed pitch P3 in the third zone. The second fixed pitch P2 is larger than the third fixed pitch P3 and smaller than the first fixed pitch P1. The first pitch P1 is located at the proximal end portion 20. The third pitch P3 is located at the distal end portion 21. The second pitch P2 is located between the first and third pitches P1, P3. While three zones are illustrated, more or fewer zones can be used. In one form, each perforated helical member 18, or a group of perforated helical members 18, can have a constant helical pitch along its particular length, while different perforated helical members 18, or a different group thereof, can have a different pitch to form a variable pitch geometric helicoid.

In an alternative configuration, not specifically shown, the perforated helicoid can be formed, not from individual members connected together, but from a single continuous helicoid member spanning from the proximal end to the distal end of the heater assembly. For example, the single helicoid member can be extruded, formed by feeding strip stock sheet metal through opposing conical dies, or 3D printed.

Figure 18:
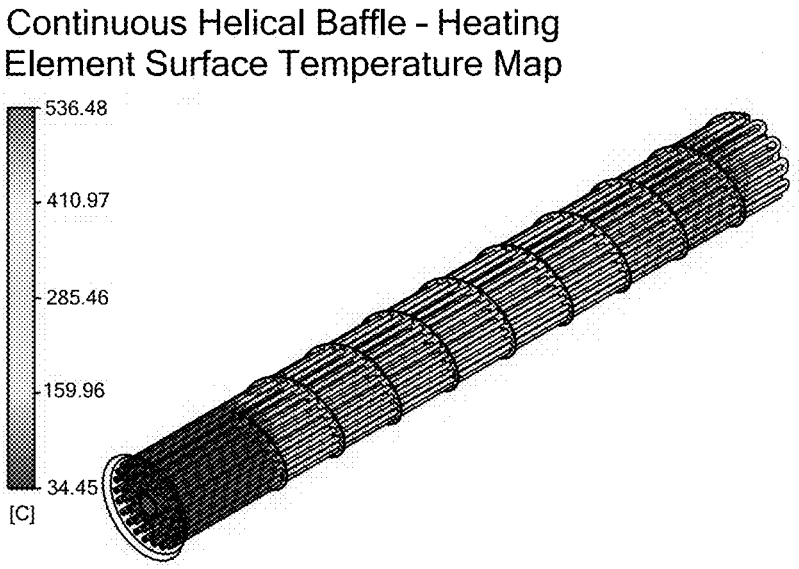
FIG. 18 is a diagram showing a temperature distribution along the heater assembly of FIG. 1.

Referring to FIG. 18, a diagram shows a temperature distribution of the heating elements 16 along the longitudinal axis X for one particular configuration of the heater assembly 10, 90. The temperature of the portions of the heating elements 16 that are adjacent to the proximal end portion of the heater assembly is approximately 33.94° C. in the particular example. As the working fluid is guided by the flow guiding channel 22 of the perforated helical members 18 and flows to the distal end portion of the heater assembly 10, 90, the temperature gradually increases to approximately 534.92° C. in the example provided. While the example provided in FIG. 18 illustrates a temperature distribution for one particular inlet temperature, electric power load to the heating elements 16, and mass flow rate of the fluid, other temperatures and distributions can result from different conditions or configurations. In general, a heater assembly constructed in accordance with the teachings of the present disclosure will have reduced heating element temperature without dead zones where the working fluid would not heated along its flow path.

Figure 19:
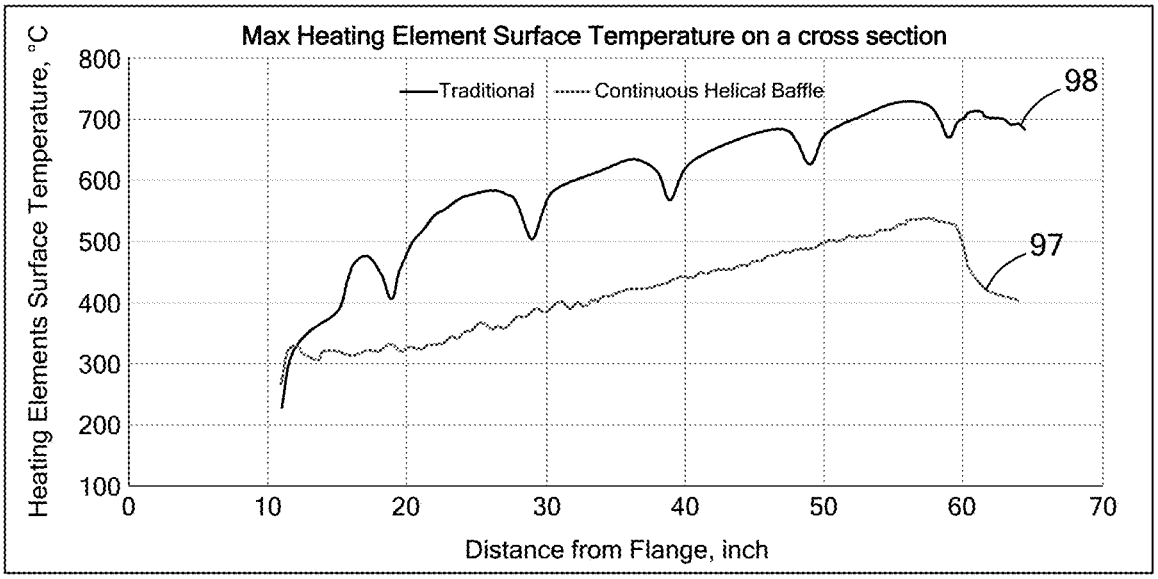
FIG. 19 is a graph showing heating element surface temperatures relative to a distance from a proximal mounting flange for a traditional heat exchanger and for a heat exchanger with the heater assembly of FIG. 18.

Referring to FIG. 19, a graph shows a relationship between the distance from the proximal mounting flange 12 and the heating element 16 temperature. The proximal mounting flange 12 is disposed proximate an inlet 86 of the heat exchanger 80. As the working fluid enters the inlet 86 and flows away from the proximal mounting flange 12, the temperature of the outer surfaces of the heating elements 16 steadily and gradually increases, as shown by line 97. In contrast, the outer surfaces of the heating elements of a typical heat exchanger (not shown) have a higher temperature that also increases and decreases as the fluid flows away from the proximal flange (i.e., from the inlet to the outlet), as shown by line 98. Accordingly, the teachings of the present disclosure provide a heater assembly and heat exchanger that provide for a consistent and lower linear temperature rise of the heating elements along a length of the heat exchanger.

The heater assembly of the present disclosure is applicable to any heating device (e.g., electric heating device) to heat a working fluid. The continuous series of the perforated helical members 18 guide the fluid to create a uniform helical cross flow pattern. The helical channel 22 of the heater assembly 10, 90 can change and increases the flow path of the working fluid without increasing the length of the heater assembly 10, 90. Therefore, the heater assembly 10, 90 can improve heat transfer from the heater assembly 10, 90 to the working fluid. With the increased heat transfer efficiency, the sheath temperature of the heating elements 16 and the temperature of the shell (e.g., tubular body 82) of the heat exchanger can be reduced, and the physical footprint of the heat exchanger can be reduced.

Moreover, the perforated helical members 18 can be formed of a thermally conductive material. Since the perforated helical members 18 may be connected to the heating elements 16 (e.g., via welds 46 shown in FIG. 7), they may be considered to be an extension of the heating elements 16 to function as extended heating surfaces or heat spreaders or fins to distribute the heat to the working fluid, thereby increasing heat transfer from the heating elements 16 to the working fluid. The central support member 40 may take the form of a cylindrical electric heating device to provide additional heating to the working fluid in the electric heat exchanger.

Furthermore, the heater assembly 10, 90 is more rigid than that in a conventional heat exchanger due to the use of the continuous series of the perforated helical members 18 and the use of the central support member 40. The central support member 40 is connected to the proximal mounting flange 12, which in turn, is connected to the body of the heat exchanger. This continuous structure improves the vibrational characteristics of the heat exchanger, thereby increasing rigidity and dampening characteristics of the heater assembly. The support rods 50 can further increase rigidity and damping characteristics.

Figure 24:
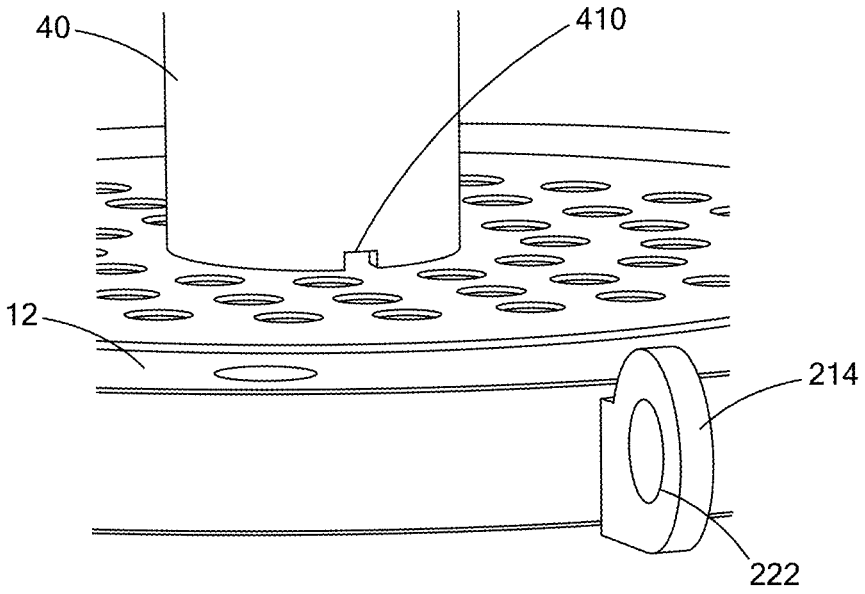
FIG. 24 is a perspective view of a central tube and mounting flange of the heater assembly of FIG. 20.
Figure 25:
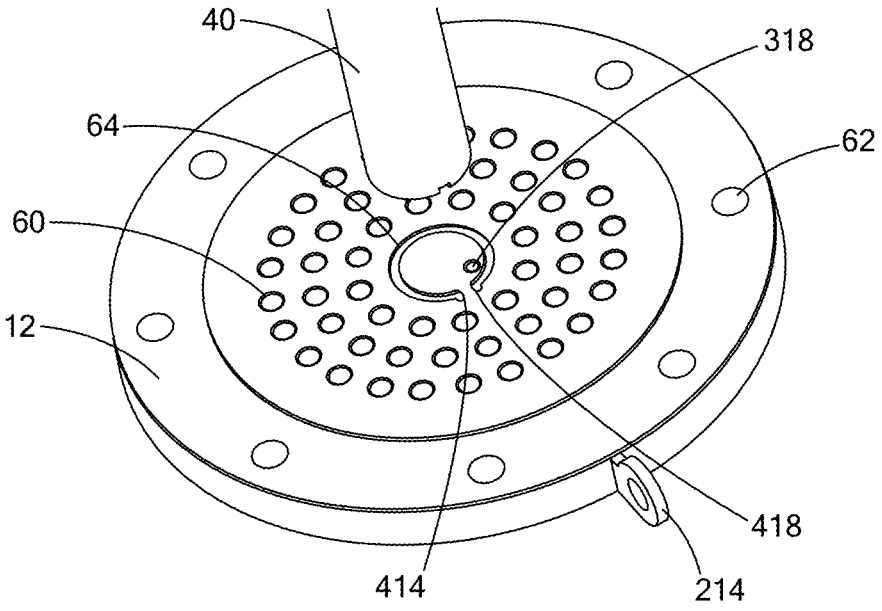
FIG. 25 is an exploded perspective view of the central tube and mounting flange of FIG. 24.
Figure 26:
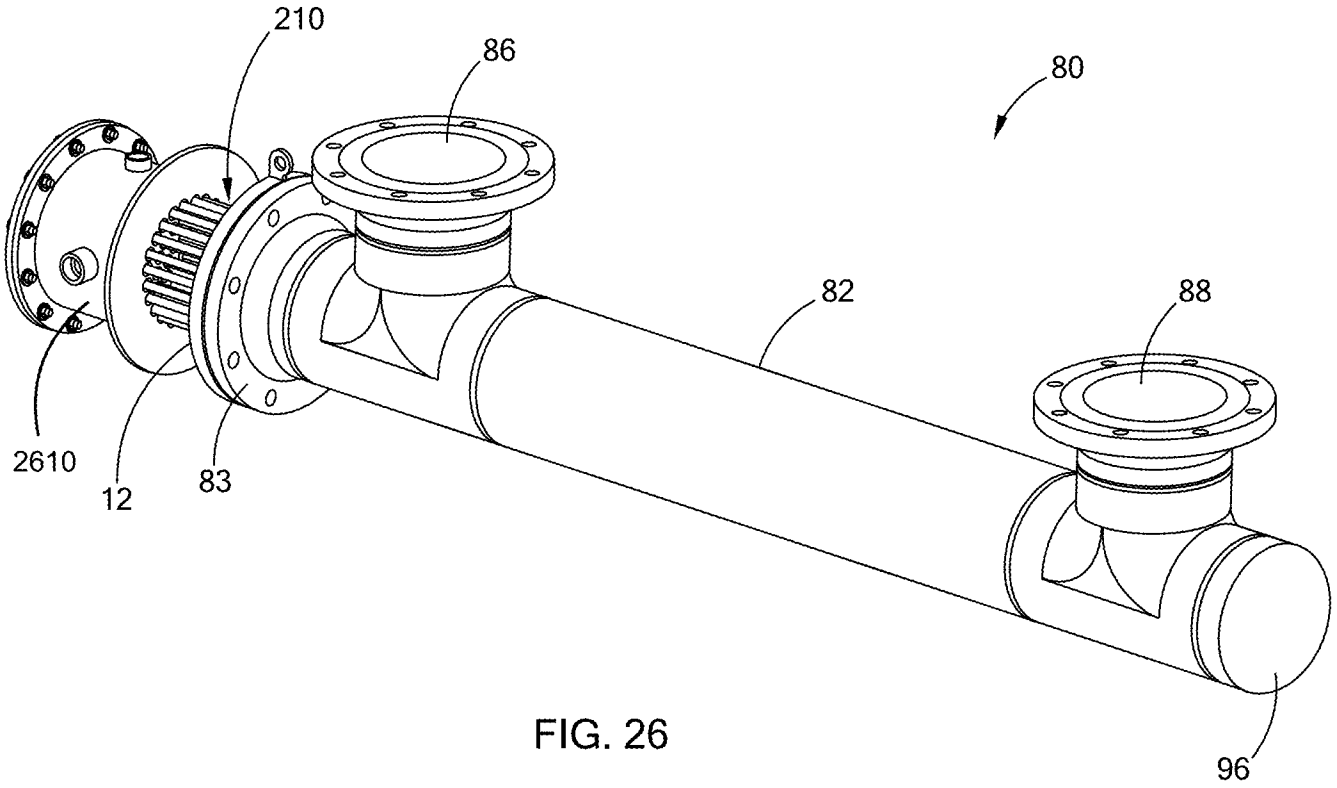
FIG. 26 is a perspective view of a heat exchanger in accordance with the teachings of the present disclosure, including the heater assembly of FIG. 20.
Figure 27:
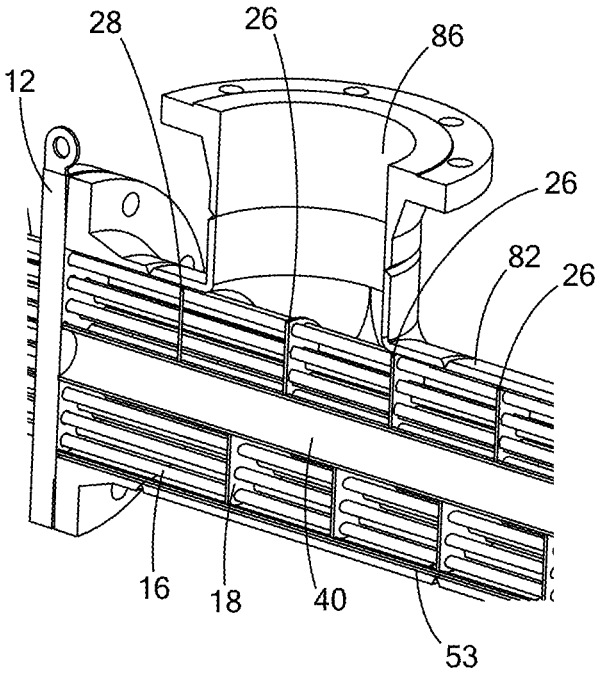
FIG. 27 is a cross-sectional view of a proximal end of the heat exchanger of FIG. 26.

With additional reference to FIGS. 20-25, a heater assembly 210, and FIGS. 26-28, a heat exchanger 80 with the heater assembly 210, are illustrated. The heat exchanger 80 and the heater assembly 210 are similar to the heat exchanger 80 and the heater assembly 10, 90, except as otherwise shown or described herein. Therefore, like elements are indicated by like reference numbers and the detailed description thereof is omitted herein for clarity.

Figure 20:
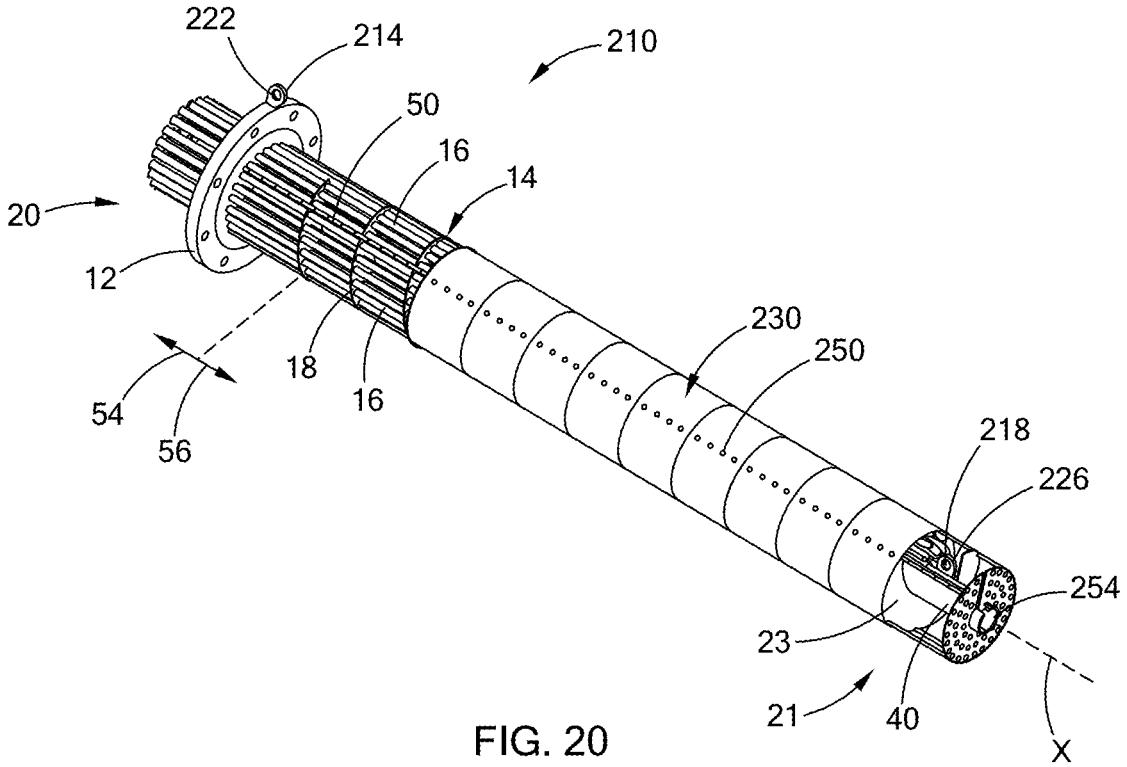
FIG. 20 is a left side perspective view of a heater assembly of a second construction in accordance with the teachings of the present disclosure, illustrated with an optional shroud installed.
Figure 21:
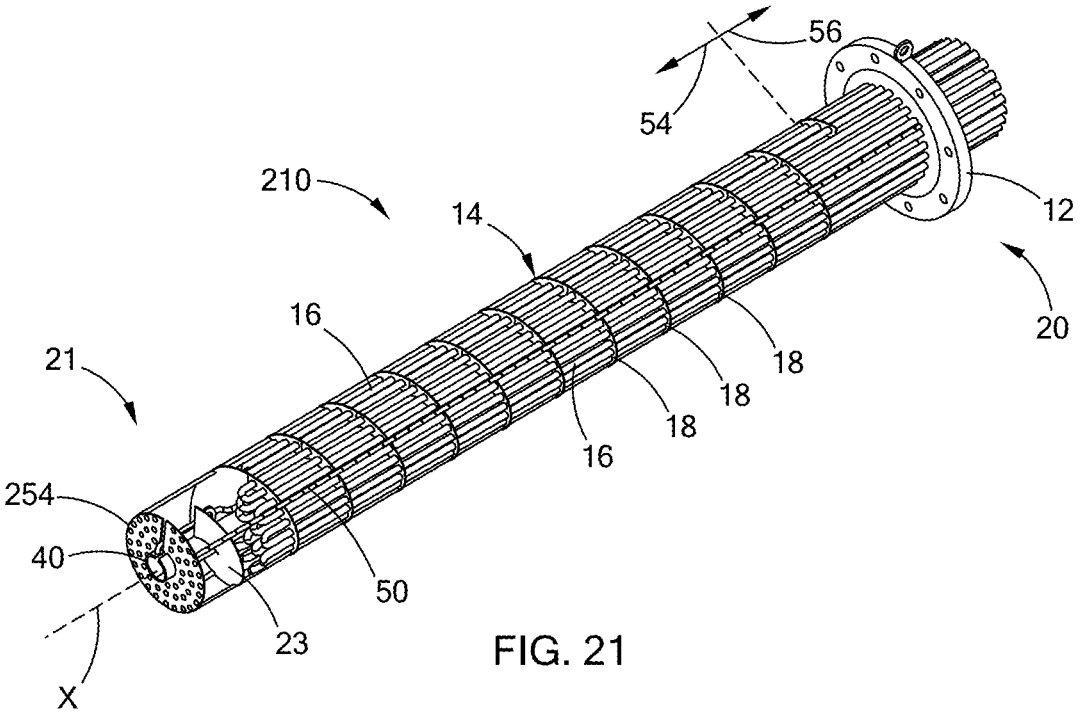
FIG. 21 is a right side perspective view of the heater assembly of FIG. 20, illustrated without the optional shroud installed.
Figure 22:
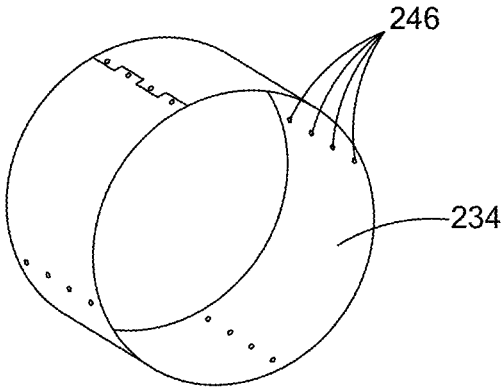
FIG. 22 is a perspective view of one section of the shroud of FIG. 20.

With reference to FIGS. 20 and 21, the heater assembly 210 can include a first lift member 214 and a second lift member 218. The first lift member 214 is fixedly coupled to a periphery of the mounting flange 12. In the example provided, the first lift member 214 extends from the top of the mounting flange 12 and defines an aperture 222, through which a hook (not shown) or other lifting device can support the proximal end of the heater assembly 210. The second lift member 218 is fixedly coupled to the distal end of the central support member 40. In the example provided, the second lift member 218 extends from the top of the central support member 40 and is aligned with the first lift member 214. The second lift member 218 defines an aperture 226, through which a hook (not shown) or other lifting device can support the distal end of the heater assembly 210. In the example provided, the second lift member 218 is disposed within the axial length of the non-perforated helical member 23, though the second lift member 218 can be beyond the non-perforated helical member 23. The first and second lift members 214, 218 can be used to lift heater assembly 210 and position the heater assembly 210 in the tubular body 82 of the heat exchanger 80.

The heater assembly 210 can further include a shroud 230. The shroud 230 wraps around the perforated helical members 18, the heating elements 16, and the support rods 50. The shroud 230 can be an axial length such that is extends along the entire length of the heated portion of the heater assembly 210 (e.g., including the shrouds 52 shown in FIG. 1), or a length that is less than the entire heated portion. With additional reference to FIG. 22, the shroud 230 can include a plurality of thin walled cylindrical shroud members 234. The shroud members 234 can inhibit blow-by between the perforated helical members 18 and the tubular body 82. The shroud members 234 can also be formed from or coated in a heat reflective material to form a heat shield that reflects heat radially inward toward the longitudinal axis X. Such a heat shield can further decrease heat loss to the body 82 and decrease the temperature of the body 82. Adjacent cylindrical shroud members 234 can abut each other along the longitudinal axis X. In one form, any of the cylindrical shroud members 234 of the shroud 230 can optionally include the deformable flaps 53 (FIGS. 13 and 14) such that the shroud 230 can also function similar to the shrouds 52 (FIGS. 1, 13, and 14).

In the example provided, the support rods 50 have a generally rectangular or cross-sectional shape and an outer surface 238 each support rod 50 is flush with the outer perimeter of the perforated and non-perforated helical members 18, 23. In one form, the outer surface 238 of each support rod 50 can have a curvature that matches the curvature of the outer perimeter of the perforated and non-perforated helical members 18, 23. The shroud 230 is attached to the support rods 50. In the example provided, the support rods 50 include a plurality of bores 242 and each cylindrical shroud member 234 includes a plurality of bores 246 that are aligned with the bores 242 of the support rods 50. Fasteners 250 (e.g., rivets, screws, etc.) or plug welds are received through the bores 242, 246 and attach the cylindrical shroud members 234 to the support rods 50.

With additional reference to FIG. 23, the heater assembly 210 can further include an alignment plate 254. The alignment plate 254 is a flat, circular disc that includes a plurality of apertures 256 and peripheral grooves 260. The apertures 256 are the same size as and align with the perforations 30 of the perforated helical members 18. The peripheral grooves 260 are the same size as and align with the peripheral grooves 36. The support rods 50 are received in the peripheral grooves 260 similar to the peripheral grooves 36. In the example provided, the alignment plate 254 defines a keyed center hole 262 having a diameter similar to the diameter of the central support member 40 and a key 264 that extends radially inward. In the example provided, the central support member 40 includes a key slot 266 that is open through the distal end of the central support member 40. The key slot 266 extends through the wall of the central support member 40 and extends longitudinally parallel to the longitudinal axis X. The key slot 266 has a width in the circumferential direction of the central support member 40 that corresponds to the width of the key 264. The central support member 40 is received through the center hole 262 and the key 264 is received in the key slot 266 to inhibit rotation of the alignment plate 254 relative to the central support member 40. In one form, the center hole 262 can include more than one key 264, spaced circumferentially about the center hole 262 and the central support member 40 can include a matching number of key slots 266.

With continued reference to FIG. 23, the heater assembly 210 can further include one or more sensors (e.g., sensor 300). In the example provided, the sensor 300 is a thermocouple or other temperature sensor, though other types of sensors can be used. The sensor 300 includes a probe end 306 that is disposed within the flow guiding channel 22. In the example provided, the probe end 306 is disposed proximate to the outlet 88 (FIGS. 26 and 28) and attached (e.g., welded or clamped) to one of the heating elements 16. The probe end 306 can be configured to detect a temperature of the heating element 16 to which it is attached. Similarly, additional sensors (not shown) can be attached to other the heating elements 16 to detect their temperatures. In an alternative configuration, not shown, the probe end 306 can be separate from the heating elements 16 and configured to detect the temperature of the working fluid at the probe end 306.

The sensor 300 extends longitudinally from the probe end 306 generally along the longitudinal axis X on the outer side of the central support member 40 toward the distal end of the central support member 40. In the example provided, the distal end of the central support member 40 includes a sensor slot 308 through the outer wall of the central support member 40 and separate from the key slot 266. The sensor 300 has bends to extend through the sensor slot 308 and into the interior cavity of the central support member 40. The sensor 300 then extends within the central support member 40 toward the proximal end of the central support member 40. With additional reference to FIG. 25, the sensor 300 extends through a bore 318 in the mounting flange 12. The bore 318 is sealed around the sensor 300 to inhibit fluid flow through the bore 318. The bore 318 is radially inward of the groove 64. In this way, the electronic connections for the sensor 300 can be on the back side of the mounting flange 12, along with electrical connections of the heating elements 16 when electrical heating elements are used.

In an alternative configuration, not shown, one aligned set of the perforations 30 can not have a heating element 16 and the temperature sensor 300 can extend through that set of perforations 30 and the corresponding flange aperture 60. In such a construction, the probe can be disposed at any desired location along the longitudinal axis X. In an alternative configuration, one or more heating elements 16 can be used as a virtual sensor to detect temperature.

With additional reference to FIGS. 24 and 25, a vent aperture 410 can permit a small amount of fluid communication between the exterior and interior of the proximal end of the central support member 40. In the example provided, the central support member has a slot through the proximal end that cooperates with the mounting flange 12 to define the vent aperture 410 when the central support member 40 is received in the groove 64 of the mounting flange 12. Unlike the groove 64 of FIG. 15, the groove 64 of FIG. 25 is an incomplete circle (i.e., does not extend a full circumference about the longitudinal axis X). Instead, the groove 64 has a start 414 and an end 418 that align with the slot in the proximal end of the central support member 40. In the example provided, the groove 64 has a flat bottom that abuts a flat bottom surface of the central support member 40. The start 414 and end 418 also form a key that ensures proper rotational alignment of the central support member 40. In the example provided, the keys between the central support member 40 and the mounting flange 12 and the alignment plate 254 cooperate to position the continuous helicoid in the correct rotational position so that the perforations 30 align with the apertures 60 and 256. In the example provided, the keys at both ends of the central support member 40 are aligned along the same line that is parallel to the longitudinal axis X, though other configurations can be used. In the example provided, the groove 64 also extends a small distance radially outward at the start 414 and end 418 of the groove 64. In the example provided, the central support member 40 is welded to the mounting flange 12 from the start 414 to the end 418 of the groove 64. In other words, the central support member 40 is welded about its circumference except for the circumferential region where the slot defines the vent aperture 410. The vent aperture 410 can be aligned with the top of the mounting flange 12. In another form, the vent aperture 410 can be a hole defined entirely by the central support member 40 near the proximal end.

With specific reference to FIG. 27, the edge 28 of the first perforated helical member 18 (i.e., near the proximal end) can be disposed along the longitudinal axis X at or before the inlet 86 such that flow from the inlet enters the flow path 22. With specific reference to FIG. 28, the opposed edge 26 of the last perforated helical member 18 (i.e., near the distal end) can be disposed along the longitudinal axis X at or before the outlet 88. In the example provided, the longest ones of the heating elements 16 extend along the longitudinal axis X to a position that is partially within the region aligned with the outlet 88, though other configurations can be used. In the example provided, the last cylindrical shroud member 234 can extend along the longitudinal axis X to overlap axially with the ends of the longest ones of the heating elements 16, to force the fluid to flow from the last heating elements 16 to the non-perforated helical member 23 before exiting from the outlet 88, though other configurations can be used.

With additional reference to FIG. 29, a portion of a heater assembly 310 of a third constructions is illustrated. The heater assembly 310 is similar to the heater assembly 10, 90, 210 except as otherwise shown or described herein. Therefore, like elements are indicated by like reference numbers and the detailed description thereof is omitted herein for clarity. In the example provided, the heating elements 16 are straight elements that terminate at a closed end 314. In other words, the straight portions 42 are not connected by bent portions. In the example provided, the heating elements 16 are electric resistance heating elements such as cartridge heaters that have all of their leads (not shown) extending from the same straight portion 42 on the opposite side of the mounting flange 12 (shown in FIG. 26).

It should be noted that the disclosure is not limited to the embodiment described and illustrated as examples. A large variety of modifications have been described and more are part of the knowledge of the person skilled in the art. These and further modifications as well as any replacement by technical equivalents may be added to the description and figures, without leaving the scope of the protection of the disclosure and of the present patent.

What is claimed is:

1. A heater assembly comprising:

a flow guide defining a continuous geometric helicoid disposed about a longitudinal axis of the heater assembly, the flow guide defining a predetermined pattern of perforations that extend in a longitudinal direction through a first longitudinal length of the geometric helicoid, the longitudinal direction being parallel to the longitudinal axis, the first longitudinal length being less than a full longitudinal length of the geometric helicoid; and a plurality of electrical resistance heating elements extending through the perforations, wherein, for each electrical resistance heating element of the plurality of electrical resistance heating elements, a length of that electrical resistance heating element and a pitch of the geometric helicoid at a distal end of that electrical resistance heating element are such that the distal end of that electrical resistance heating element is a distance X from the geometric helicoid at the distal end of that electrical resistance heating element, wherein the distance X is taken along the longitudinal direction and is less than or equal to 40% of the pitch of the geometric helicoid at the distal end of that electrical resistance heating element.

2. The heater assembly according to claim 1, wherein the plurality of electrical resistance heating elements include a plurality of distinct sets of electrical resistance heating elements, each distinct set extending along the longitudinal direction a different length than each other distinct set of electrical resistance heating elements.

3. The heater assembly according to claim 2, wherein the plurality of distinct sets of electrical resistance heating elements includes a first set of electrical resistance heating elements, a second set of electrical resistance heating elements, a third of electrical resistance heating elements, and a fourth set of electrical resistance heating elements, wherein the first, second, third, and fourth sets of electrical resistance heating elements are each located in a respective quadrant about the longitudinal axis.

4. The heater assembly according to claim 3, wherein the first, second, third, and fourth sets of electrical resistance heating elements each have the same or approximately the same number of heating elements.

5. The heater assembly according to claim 3, wherein the fourth set of electrical resistance heating elements extends farther in the longitudinal direction than the third set of electrical resistance heating elements, wherein the third set of electrical resistance heating elements extends farther in the longitudinal direction than the second set of electrical resistance heating elements, wherein the second set of electrical resistance heating elements extends farther in the longitudinal direction than the first set of electrical resistance heating elements.

6. The heater assembly according to claim 5 further comprising:

a tubular body including a first inlet/outlet open into an interior of the tubular body at a first end portion of the tubular body, and a second inlet/outlet open into the interior of the tubular body at a second end portion of the tubular body, wherein the flow guide is disposed within the tubular body, and wherein the fourth set of electrical resistance heating elements overlaps in the longitudinal direction with the second inlet/outlet and the first set of electrical resistance heating elements do not overlap in the longitudinal direction with the second inlet/outlet.

7. The heater assembly according to claim 6, wherein the second set of electrical resistance heating elements do not overlap in the longitudinal direction with the second inlet/outlet.

8. The heater assembly according to claim 7, wherein the third set of electrical resistance heating elements do not overlap in the longitudinal direction with the second inlet/outlet.

9. The heater assembly according to claim 2 further comprising:

a tubular body including a first inlet/outlet open into an interior of the tubular body at a first end portion of the tubular body, and a second inlet/outlet open into the interior of the tubular body at a second end portion of the tubular body, wherein the flow guide is disposed within the tubular body such that the geometric helicoid and the tubular body define a helical flow path between the first inlet/outlet and the second inlet/outlet, and wherein the plurality of distinct sets of electrical resistance heating elements are arranged such that the distinct sets progressively extend farther in the longitudinal direction with increased position along the helical flow path.

10. The heater assembly according to claim 1, wherein each electrical resistance heating element of the plurality of electrical resistance heating elements includes a resistance wire, an insulating material, and a sheath, the sheath surrounding the resistance wire, the insulating material being disposed between the resistance wire and the sheath and electrically insulating the resistance wire from the sheath, wherein the sheath includes a first straight portion, a second straight portion, and a bend connecting a distal end of the first straight portion to a distal end of the second straight portion.

11. The heater assembly according to claim 1, wherein each electrical resistance heating element of the plurality of electrical resistance heating elements includes a resistance wire, an insulating material, and a sheath, the sheath surrounding the resistance wire, the insulating material being disposed between the resistance wire and the sheath and electrically insulating the resistance wire from the sheath, wherein the sheath includes a straight portion that terminates at the distal end of the electrical resistance heating element.

12. The heater assembly according to claim 1, wherein the distance X is less than or equal to 10% of the pitch of the geometric helicoid at the distal end of that electrical resistance heating element.

13. The heater assembly according to claim 1 further comprising:

a tubular body including a first inlet/outlet open into an interior of the tubular body at a first end portion of the tubular body, and a second inlet/outlet open into the interior of the tubular body at a second end portion of the tubular body, wherein the flow guide is disposed within the tubular body such that the geometric helicoid and the tubular body define a helical pathway between the first inlet/outlet and the second inlet/outlet with the second inlet/outlet being further in the longitudinal direction than the first inlet/outlet, and wherein none of the electrical resistance heating elements of the plurality of electrical resistance heating elements terminates in a region of the helical pathway that is rotationally beyond the second inlet/outlet.

14. A heater assembly comprising:

a flow guide defining a continuous geometric helicoid disposed about a longitudinal axis of the heater assembly, the flow guide defining a predetermined pattern of perforations that extend in a longitudinal direction through a first longitudinal length of the geometric helicoid, the longitudinal direction being parallel to the longitudinal axis, the first longitudinal length being less than a full longitudinal length of the geometric helicoid; and a plurality of electrical resistance heating elements extending through the perforations, wherein, for each electrical resistance heating element of the plurality of electrical resistance heating elements, a length of that electrical resistance heating element and a pitch of the geometric helicoid at a distal end of that electrical resistance heating element are such that the distal end of that electrical resistance heating element is a distance X from the geometric helicoid at the distal end of that electrical resistance heating element, wherein the distance X is taken along the longitudinal direction and is less than or equal to 40% of the pitch of the geometric helicoid at the distal end of that electrical resistance heating element, wherein the plurality of electrical resistance heating elements includes a plurality of distinct sets of electrical resistance heating elements, each distinct set extending along the longitudinal direction a different length than each other distinct set of electrical resistance heating elements, wherein the geometric helicoid defines a helical pathway and the plurality of distinct sets of electrical resistance heating elements are arranged such that the distinct sets progressively extend farther in the longitudinal direction with increased position along the helical pathway.

15. The heater assembly according to claim 14, wherein each electrical resistance heating element of the plurality of electrical resistance heating elements includes a resistance wire, an insulating material, and a sheath, the sheath surrounding the resistance wire, the insulating material being disposed between the resistance wire and the sheath and electrically insulating the resistance wire from the sheath, wherein the sheath includes a first straight portion, a second straight portion, and a bend connecting a distal end of the first straight portion to a distal end of the second straight portion.

16. The heater assembly according to claim 14, wherein each electrical resistance heating element of the plurality of electrical resistance heating elements includes a resistance wire, an insulating material, and a sheath, the sheath surrounding the resistance wire, the insulating material being disposed between the resistance wire and the sheath and electrically insulating the resistance wire from the sheath, wherein the sheath includes a straight portion that terminates at the distal end of the electrical resistance heating element.

17. The heater assembly according to claim 14 further comprising:

a tubular body including a first inlet/outlet open into an interior of the tubular body at a first end portion of the tubular body, and a second inlet/outlet open into the interior of the tubular body at a second end portion of the tubular body, wherein the flow guide is disposed within the tubular body with the second inlet/outlet being further in the longitudinal direction than the first inlet/outlet, and wherein none of the electrical resistance heating elements of the plurality of electrical resistance heating elements terminates in a region of the helical pathway that is rotationally beyond the second inlet/outlet.

18. A heater assembly comprising:

a flow guide defining a continuous geometric helicoid disposed about a longitudinal axis of the heater assembly, the flow guide defining a predetermined pattern of perforations that extend in a longitudinal direction through a first longitudinal length of the geometric helicoid, the longitudinal direction being parallel to the longitudinal axis, the first longitudinal length being less than a full longitudinal length of the geometric helicoid;

a plurality of electrical resistance heating elements extending through the perforations; and a tubular body including a first inlet/outlet open into an interior of the tubular body at a first end portion of the tubular body, and a second inlet/outlet open into the interior of the tubular body at a second end portion of the tubular body, the second inlet/outlet being farther in the longitudinal direction than the first inlet/outlet, wherein, for each electrical resistance heating element of the plurality of electrical resistance heating elements, a length of that electrical resistance heating element and a pitch of the geometric helicoid at a distal end of that electrical resistance heating element are such that the distal end of that electrical resistance heating element is a distance X from the geometric helicoid at the distal end of that electrical resistance heating element, wherein the distance X is taken along the longitudinal direction and is less than or equal to 10% of the pitch of the geometric helicoid at the distal end of that electrical resistance heating element, wherein the flow guide is disposed within the tubular body such that the geometric helicoid and the tubular body define a helical pathway, and wherein none of the electrical resistance heating elements of the plurality of electrical resistance heating elements terminates in a region of the helical pathway that is rotationally beyond the second inlet/outlet.

19. The heater assembly according to claim 18, wherein each electrical resistance heating element of the plurality of electrical resistance heating elements includes a resistance wire, an insulating material, and a sheath, the sheath surrounding the resistance wire, the insulating material being disposed between the resistance wire and the sheath and electrically insulating the resistance wire from the sheath, wherein the sheath includes a first straight portion, a second straight portion, and a bend connecting a distal end of the first straight portion to a distal end of the second straight portion.

20. The heater assembly according to claim 18, wherein each electrical resistance heating element of the plurality of electrical resistance heating elements includes a resistance wire, an insulating material, and a sheath, the sheath surrounding the resistance wire, the insulating material being disposed between the resistance wire and the sheath and electrically insulating the resistance wire from the sheath, wherein the sheath includes a straight portion that terminates at the distal end of the electrical resistance heating element.

* * * * *